United States Patent [19]

Kikuchi et al.

[11] Patent Number: 5,030,020

[45] Date of Patent: Jul. 9, 1991

[54] WIRE-DOT IMPACT PRINTER HAVING MEANS FOR DETECTING DISPLACEMENT OF INDIVIDUAL PRINT WIRES

[75] Inventors: Hiroshi Kikuchi; Jiro Tanuma; Hideaki Ishimizu; Chihiro Komori, all of Tokyo, Japan

[73] Assignee: Oki Electric Industry Co., Ltd., Tokyo, Japan

[21] Appl. No.: 393,903

[22] PCT Filed: Nov. 25, 1988

[86] PCT No.: PCT/JP88/01190

§ 371 Date: Jul. 21, 1989

§ 102(e) Date: Jul. 21, 1989

[87] PCT Pub. No.: WO89/04765

PCT Pub. Date: Jun. 1, 1989

[30] Foreign Application Priority Data

| | | | |
|---|---|---|---|
| Nov. 27, 1987 | [JP] | Japan | 62-301194 |
| Nov. 27, 1987 | [JP] | Japan | 62-301195 |
| Nov. 27, 1987 | [JP] | Japan | 62-301196 |

[51] Int. Cl.[5] ..... B41J 2/27; B41J 2/235

[52] U.S. Cl. ..... 400/124; 400/157.2; 101/93.14

[58] Field of Search ..... 400/124, 157.2; 101/93.14

[56] References Cited

U.S. PATENT DOCUMENTS

| | | | |
|---|---|---|---|
| 3,872,788 | 3/1975 | Palombo | 101/93.14 |
| 4,347,786 | 9/1982 | Sweat, Jr. et al. . | |
| 4,440,079 | 4/1984 | Dayger et al. | 101/93.03 |
| 4,468,140 | 8/1984 | Harris | 700/124 |
| 4,597,328 | 7/1986 | Carrington et al. | 101/93.13 |
| 4,844,635 | 7/1989 | Malkemes et al. | 400/124 |

FOREIGN PATENT DOCUMENTS

| | | |
|---|---|---|
| 0305871A1 | 3/1989 | European Pat. Off. . |
| 0318448A2 | 5/1989 | European Pat. Off. . |
| 592864 | 12/1989 | Japan . |
| 2143970A | 2/1985 | United Kingdom . |

*Primary Examiner*—Edgar S. Burr
*Assistant Examiner*—Joseph R. Keating
*Attorney, Agent, or Firm*—Wenderoth, Lind & Ponack

[57] ABSTRACT

A wire-dot impact printer includes a wire-dot print head having a plurality of print wires disposed therein. Each of the plurality of print wires has a distal end, and each is displaced in response to a drive signal so as to strike a printing medium with the distal end. A displacement detecting device is provided for detecting a displacement resulting from the drive signal of each of the plurality of print wires and for outputting a corresponding displacement detection signal. A control unit, which controls the overall printing operation of the impact printer, varies the print repetitive cycle of each of the plurality of print wires in accordance with the displacement detection signal outputted by the displacement detecting unit.

8 Claims, 20 Drawing Sheets

Fig. 22(a)

CORRECTION OF THE NUMBER OF PRINTING WIRES EFFECTING SIMULTANEOUS PRINTING

| THE NUMBER OF PRINTING WIRES EFFECTING SIMULTANEOUS PRINTING | 0 | 1 | 2 | 3 | 4 | 5 | 6 | 7 | 8 | 9 |
|---|---|---|---|---|---|---|---|---|---|---|
| CORRECTION NUMBER $C_1$ | 0 | 1 | 2 | 3 | 5 | 7 | 9 | 12 | 15 | 19 |

Fig. 22(b)

CORRECTION OF THE PAST PRINTING RECORD

| NUMBER OF WIRES EFFECTING PREVIOUS PRINTING | 0 ~ 4 | | 5~9 | |
|---|---|---|---|---|
| ITS OWN PRINTING WIRES ARE INCLUDE ? | YES | NO | YES | NO |
| CORRECTION NUMBER $C_2$ | +2 | -2 | +4 | 0 |

Fig. 22(c)

CORRECTION OF HEAD GAP

| GAP VALUE | 0~2 | 3~4 | 5~6 | 7~9 | 10~14 | 14~15 |
|---|---|---|---|---|---|---|
| CORRECTION NUMBER $C_3$ | -5 | -4 | -2 | 0 | +2 | +4 |

Fig. 22(d)

CORRECTION OF THE VARIATION OF THE PRINT WIRE

| | THE NUMBER OF PRINTING WIRES \ VARIATION | -15 ~-12 | -12 ~-10 | -9 ~-7 | -6 ~-4 | -3 ~0 | 1 ~3 | 4 ~6 | 7 ~9 | 10 ~12 |
|---|---|---|---|---|---|---|---|---|---|---|
| CORRECTION NUMBER $C_4$ | 0 ~ 4 | -8 | -6 | -4 | -2 | 0 | 2 | 4 | 6 | 8 |
| | 5 ~ 7 | -8 | -6 | -4 | -2 | 0 | 2 | 4 | 7 | 10 |
| | 8 ~ 9 | -8 | -6 | -4 | -2 | 0 | 2 | 5 | 8 | 12 |

Fig. 26

| THE NUMBER OF PRINTING WIRES EFFECTING SIMULTANEOUS PRINTING | DELAY TIME (μsec) | CORRECTION VALUE Co |
|---|---|---|
| 1 | 0 | Co = 7 |
| 2 | 0 | Co = 7 |
| 3 | 0 | Co = 7 |
| 4 | 1 | Co = 6 |
| 5 | 2 | Co = 5 |
| 6 | 4 | Co = 4 |
| 7 | 6 | Co = 3 |
| 8 | 9 | Co = 2 |
| 9 | 13 | Co = 0 |

WIRE-DOT IMPACT PRINTER HAVING MEANS FOR DETECTING DISPLACEMENT OF INDIVIDUAL PRINT WIRES

FIELD OF THE INVENTION

The present invention relates to a wire-dot impact printer capable of printing by striking a printing wire provided at a wire-dot printing head onto a printing medium, especially to a wire-dot impact printer adapted for high quality printing.

BACKGROUND OF THE INVENTION

There is illustrated in FIG. 1 a construction of this type of wire-dot impact printer adopted conventionally. In the same figure, designated at 100 is a centro I/F, 101 is a CPU, 102 is I/O LSI as an interface, 103 is a timer, 104 is a head driver, 105 is a wire-dot head, 106 is an operation switch, 107 is a line feed motor, 108 is a spacing motor. In the apparatus, the CPU 101 receives a printing date via the centro I/F 100 and supplies a control signal issued on the basis of the printing data to the timer 103, the head driver 104, the line feed motor 107 and the spacing motor 108 via the I/O LSI 102. The head driver 104 receives a control signal from the CPU 101 and a drive timing signal from the timer 103 for driving the wire-dot printing head 105 to effect printing.

As the wire-dot printing head 105, there is an arrangement as illustrated in FIG. 2. In the same figure, designated at 110 are a plurality of printing wires (two printing wires are illustrated in the same figure) provided in the wire-dot printing head 105, 111 is a guide frame having a guide groove llla, 112 is an armature for supporting the printing wires 110, and 113 is a plate spring for supporting the armature 112. Hereupon, designated at 114 is a base plate, 115 is an electromagnet composed of a core 115*a* and a coil 115*b* wound around the core 115*a*, 116 is a permanent magnet, 117 is a rack, 118 is a spacer, 119 is a yoke, and 120 is a clamp. The clamp 120 presses and holds the base plate 114, the permanent magnet 116, the rack 117, the spacer 118, the plate spring 113, the yoke 119, the front cover 111 in a manner such that each of these members are laid one over another in turn and integrated.

The armature 112 is supported at the side of a free end 113*a* of the plate spring 113 while a base end 110*a* of one of the printing wires 100 is fixedly mounted on a distal end 112*a* of the armature 112. A distal end 110*b* of the printing wire 110 is guided by the guide groove 111*a* of the guide frame 111 so as to strike a predetermined position of the printing paper (not shown).

With the arrangement as set forth above, when the coil 115*b* of the electromagnet 115 is deenergized, the armature 112 is attracted to the side of the base plate 114 (downward direction in the figure) by the attraction force of the permanent magnet 116 against the resilience force of the plate spring 113. When the coil 115*b* is energized, a magnet flux of the permanent magnet 116 is cancelled by the magnet flux of the electromagnet 115 to release the armature 112 from the attraction force of the permanent magent 116 to move the armature 112 toward the side of the guide frame 111 (upward direction in the same figure) by the resilience force of the place spring 113. At the same instant, the printing wire 110 provided at the armature 112 moves toward the side of the guide frame 111 and the distal end 110*b* thereof projects over the guide slit 111*a* and strikes the printing paper to effect printing.

FIG. 3 is a circuit diagram of the timer 103 and FIG. 4 is a waveform diagram of the operation of the timer circuit 103. The timer 103 is a portion to adjust an optimum time for energizing the coil 115*b* on the basis of the voltage to be applied to the coil 115*b*.

In the same figure, designated at 120 is an open-collector type NOT circuit, 121, 122, 123 are resistors, 124 is a diode, 125 is a capacitor, and 126 is a comparator. The timer circuit 103 operates as follows. Firstly, a signal tl received from the I/O LSI 102 is applied to the NOT circuit 120 on the basis of the instruction from the CPU 101. The signal, t1 becomes high level (5 V) during the period of T1 as illustrated in FIG. 4. At the time when the signal t1 is in high level, an output of the NOT circuit 120 becomes low level (0 V) whereby the electric charge of the capacitor 125 is sharply discharged. After the lapse of the time T1 the signal t1 is returned to low level so that the capacitor 125 is re-charged by a drive power supply voltage Vh which is applied to the wire-dot printing head via the resistor 121 and the output voltage of the NOT circuit 120 increases. The comparator 126 compares a reference voltage Vr which is decided bY the resistance values R122, R123 of the resistors 122, 123 and a power supply Vcc supplied to the logic circuit, which is expressed as R123/(R122+R123) Vcc and the output voltage of the NOT circuit 120. An output signal t2 of the comparator 126 becomes high level during the output voltage of the NOT circuit 120 is lower than the reference voltage Vr while it returned to low level at the time when the output voltage of the NOT circuit 120 reaches the reference compare voltage Vr (after the lapse of time T2). Accordingly, in the case where the drive supply power voltage Vh is high the output voltage of the NOT circuit 120 reaches the reference voltage Vr quickly so that the time T2 when the output of the compartor 126 keeps high level is shortened. In the case where the drive supply power voltage Vh of the wire-dot printing head is low, the time when the output voltage of the NOT circuit 120 reaches the reference voltage Vr in a long period of time, hence the time T2 becomes long.

FIG. 5 illustrates a circuit diagram, of the head driver 104 and FIG. 6 is a waveform diagram of the operation of the head driver 104. In the same figures, denoted at 130 is a buffer gate, 131 is an AND gate, 132, 133, 134 are transistors, 135, 136 are resistors, 137, 138 are diodes, and 115b is the head coil as shown in FIG. 2. The head driver 104 operates as follows. First1y, the buffer gate 130 receives the signal t2 (over drive signal) shown in FIG. 6 from the timer circuit 103 and applies the drive power supply voltage Vh to the head coil 115b. Since the AND circuit 131 receives an enable signal t3 from the timer circuit 103 and a print signal t4 from the I/O LSI 102, the signals t3 and t4 are ANDed at the AND circuit to issue an AND signal to the base of the transistor 134 via a resistor 136. The print signal t4 is a selection signal of the print wire corresponding to the characters to be printed. Accordingly, in the case where all the signals t2, t3 and t4 are high levels, both the transistors 133, 134 will be ON so that the drive power supply voltage Vh is applied to the head coil 115*b*. Then, the current Ih flows in the direction of the arrow Hl as shown in the one dot one dash line in FIG. 5, and the current value thereof is increased gradually as shown within a range F1 of FIG. 6. In the case where the output of the signal t2 becomes low level after the lapse of time T2, the transistor 133 is OFF so that on the basis of a reverse electromotive force of the head coil 115*b* a circuit current flows in the direction of the arrow H2 as shown in the two dot one dash line whereby the current value of the current Ih is gradually decreased as shown within a range F2. In the case where the output of the signal t3 becomes low level, the transistor 134 is OFF so that the current Ih flows in the direction of the arrow H3 as shown in the three dot and one dash line and the current value of the current Ih is sharply decreased as shown within a range F3.

In the prior art as described above, in the case where the drive power supply voltage Vh of the wire-dot printing head is high, the time T2 when the signal t2 becomes high level is shortened to thereby shorten the range F1 of the current Ih, while in the case where the drive power supply voltage Vh is low, the time T2 is lengthened to thereby lengthen the range F1 of the current Ih. That is, the current Ih is controlled corresponding to the variation of the power supply voltage VH to be applied to the head coil 115*b* in order to fix the time of the drive time required from the drive timing for instructing the printing wire 110 to start printing (timing where the signal t1 becomes from the low level to the high level) to the print timing where the printing wire 110 actually strikes the printing paper.

Meanwhile, the drive time from the drive timing to the print timing are differentiated for each print wire by the variation of the interval between the printing wire 110 and the printing medium and magnetic interference of the head coil 115*b* in the wire-dot printing head 105.

However, in the prior art as described above, although the correction of the variation of the drive power supply volatage Vh of the head coil 115*b* is made with respect to the drive time of the wire-dot printing head 105, the drive timing for each printing wire 110 is the same and not individually set for each printing wire 110. Therefore, a timing divergence-lag is present between each printing wire 110 thereby producing a displacement of the printing position which results in deterioration of the printing quality.

Furthermore, there was no means for correcting the variation of characteristics of each wire-dot printing head 105 and each printing wire 110 whereby the driving time of the printing wire 110 is not optionally set to optimum for the wire-dot printing head 105 used at that time. In the case where the driving time is less than the optimum value, the energy required for operating the printing wire 110 is small to thereby weaken the striking force of the printing wire 110 against the printing medium to deteriorate the printing quality. To solve, t,he problem, in considering the variation of characteristics each for the wire-dot printing head 105 and the printing wire 110, the driving time is set to be somewhat longer to provide a margin to some extent for the driving time. However, there were problems in that adoption of the step has required much energy for operating the printing wire 110 to thereby, first1y generate much heat in the head coil 115*b*, and secondly, sometimes a thermal alarm function is operated for preventing the printing head from being highly heated for suspending the operation of the apparatus whereby a throughput is decreased.

Furthermore, a minimum value of the print repetitive cycle due to driving of the wire-dot printing head 105 in the printing process is fixed. That is, a printing speed F (number/sec) (number of printing characters per unit time) in the one line printing operation is gradually increased from the print starting position as illustrated in FIG. 7, maintained at the same speed when it reaches a nominal printing speed Fn, and thereafter decreases gradually at the time close to the print ending position. Accordingly, the orint reoetitive cycle is gradually decreased at the print starting position and is minimum at the constant printing mode and is gradually increased at the print ending position. An optimum value variable in various conditions exists in a minimum value in the printing operation during a prescribed cycle among the print repetitive cycles. For example, in case that the printing medium is one piece of paper, the time taken for actuation operation of the printing wire 110, striking of the the printing medium by the distal end 110*b* thereof, and returning to the original position of the same (hereafter referred to as a flight time) is a relatively short period. This is caused because the energy when the printing wire 110 struck onto the printing paper is not fully absorbed in the printing paper in case that the printing medium is one piece of paper whereby the printing wire 110 is forcibly bounced due to the resilience force of the platen and the like for supporting the rear of the printing paper. Accordingly, in this case the flight time can be shortened to thereby shorten the print repetitive cycle and increase the printing speed.

However, if the minimum value of the print repetitive cycle is determined in accordance with the flight time of the single paper in the case where coping papers as a printing medium composed of a couple of carbon papers, etc. lay one on another, the coping papers absorb the energY at the time of striking of the printing wire 110 greater than the case of single paper to thereby weaken the elastic bouncing force caused by the platen and the like so that the printing wire returns slowly to its original position. In such case, the flight time is longer, occasionally, than the print repetitive cylce so that the printing wire 110 can not return to its original position before the next printing operation. As a result, it generated such a problem that the, striking energy of the printing wire in the next printing operation is insufficient to thereby considerably deteriorate the printing quality. There was proposed a method for controlling to decide the minimum value of the print repetitive cycle in view of the maximum time of the flight time which varies depending on the kind of printing medium. This method requires that the wire-dot printing head can be used in the large print repetitive cycle which generates such a problem that the printing speed may be reduced than that to be effected by the inherent capacity of the wire-dot printing head.

As another step, a method for controlling to swit-hc the minimum value of the print repetitive cycle in several stages in accordance with the head gap is not a means to solve fully the problem since the flight time is controlled not only by the thickness of the printing medium but the material of the printing medium and also affected by the variation of the characteristic of the wire-dot printing head or variation of the power supply voltage.

Accordingly, it is an object of the present invention to provide a wire dot impact printer to solve the aforementioned problems of the prior art in the manner of preventing the printing from becoming out of position by striking simultaneously a plurality of printing wires onto the printing medium, or correcting the variable of the characteristic for each printing wire, or setting the optimum print repetitive cylce whereby the high qaulity printing can be carried out.

SUMMARY OF THE INVENTION

The present invention relates to the wire-dot impact printer capable of printing by striking distal ends of a plurality of printing wires provided at a wire-dot printing head selectively onto the printing medium and having a sensor for detecting a displacement of the printing wire or print timing when the printing wire is operated in the wire-dot printing head. In the detection of the displacement of the printing wire, the reoetiti,ve cycle of the printing wire is controlled by a flight time or the correction of the displacement of the printing head can be controlled by the operation time-current characteristic inherent to each printing wire. In the detection of the print timing of the printing wire, print timing of a plurality of printing wires are controlled simultaneously.

With the above arrangement and the control method, it is possible to obtain the wire-dot impact printer eliminating the reduction of the printing speed, the deviation, of the characteristic, or the printing from becoming out of position to thereby carry ou a high quality printing operation.

BRIEF DESCRIPTION OF THE DRAWINGS

FIGS. 22(*a*), 22(*b*), 22(*c*), 22(*d*) are views showing respectively specific examples of correction values stored in ROM;

FIG. 26 is a view showing a specific correction value Co in the case where a plurality of printing wires are simultaneously operated.

BEST MODE FOR EMBODYING THE PRESENT INVENTION

Figure 8:
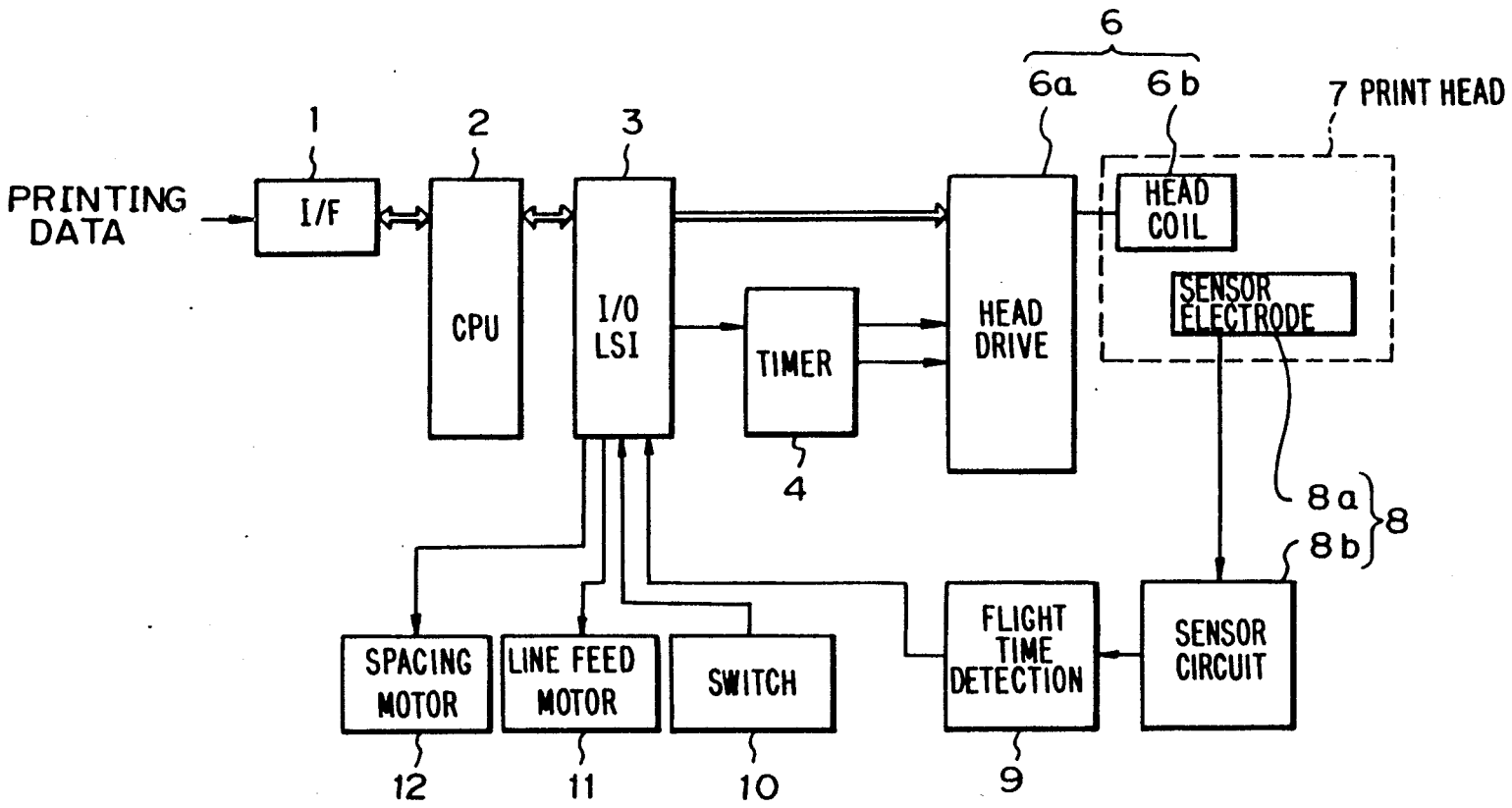
FIG. 8 is a block diagram of a wire dot impact printer according to an embodiment of the present invention.

FIG. 8 is a block diagram of a wire-dot printer according to an embodiment of the present invention. In the same figure, designated at 1 is a centro I/F adopted in the present invention as an interface for receiving the printing data, 2 is a CPU as a controller for controlling the operation of the whole apparatus, 3 is an I/O LSI as an interface, 4 is a timer circuit, 6*a* is a head drive, 6*b* is a head coil, 6 is a drive means for driving a printing wire having the head driver 6*a* and the head coil 6*b*, 7 is a wire-dot printing head having the printing wire, 8*a* is a sensor electrode, 8*b* is an electrostatic capacitor sensor circuit (hereafte referred to as sensor circuit), 8 is a variation detection means composed of a sensor electrode 8*a* and the sensor circuit 8*b*, 9 is a flight time detection circuit for detecting the flight time counting from the actuation of the wire-dot printing head 7 to the return of the same to its original position, 10 is an operation switch, 11 is a line feed motor for feeding a printing paper as a printing medium in the longitudinal direction, and 12 is a spacing motor for moving the wire-dot printing head 7 in the width direction of the printing paper.

According to the present invention, the CPU 2 receives a printing data via the centro I/F 1 and supplies a signal issued from this printing data to the head drive 6*a*, the line feed motor 11 and the spacing motor 12 via the I/O LSI 3. The head driver 6*a* drives the wire-dot printing head 7 and carries out a printing operation on the basis of a signal received from the CPU 2 and a signal received from the timer circuit 4.

Figure 1:
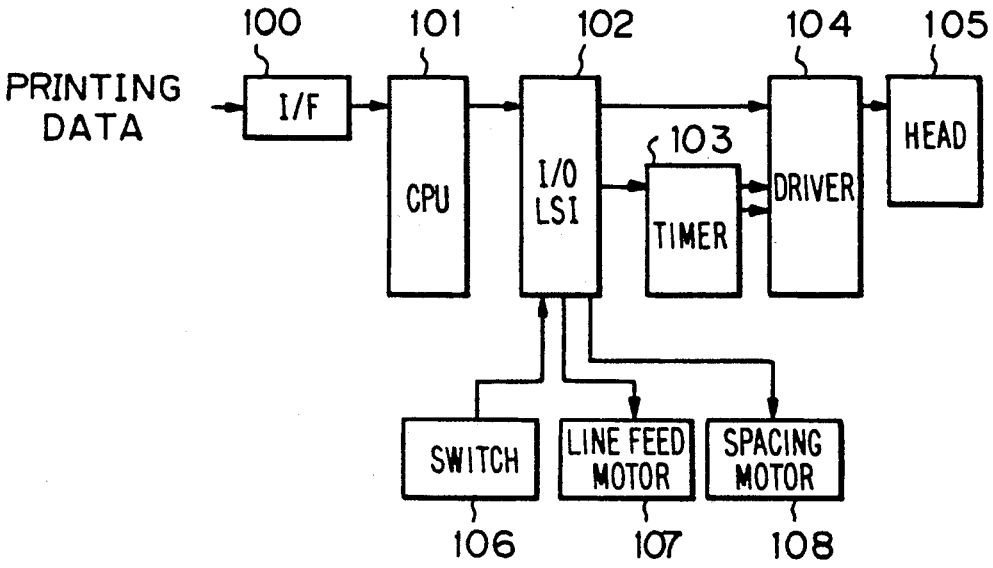
Fig. 1 (PRIOR ART)
FIG. 1 is a block diagram of a prior art.
Figure 2:
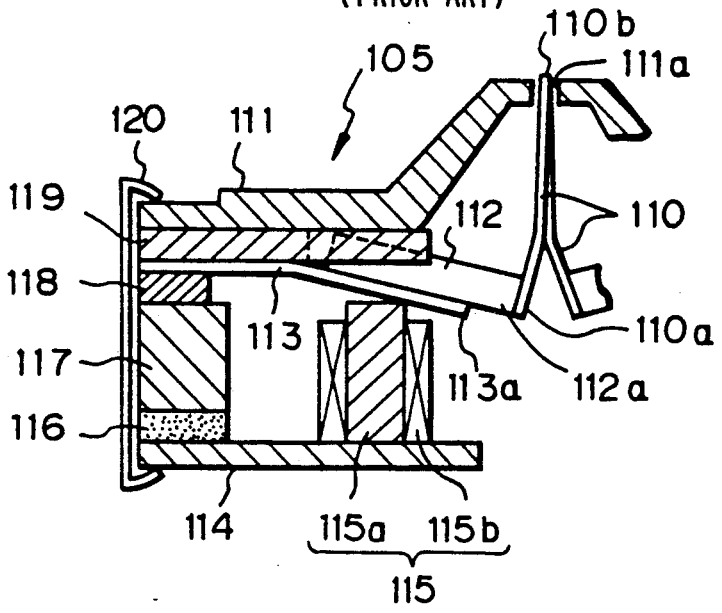
Fig. 2 (PRIOR ART)
FIG. 2 is a longitudinal cross sectional view of a wire-dot printing head of FIG. 3.
Figure 3:
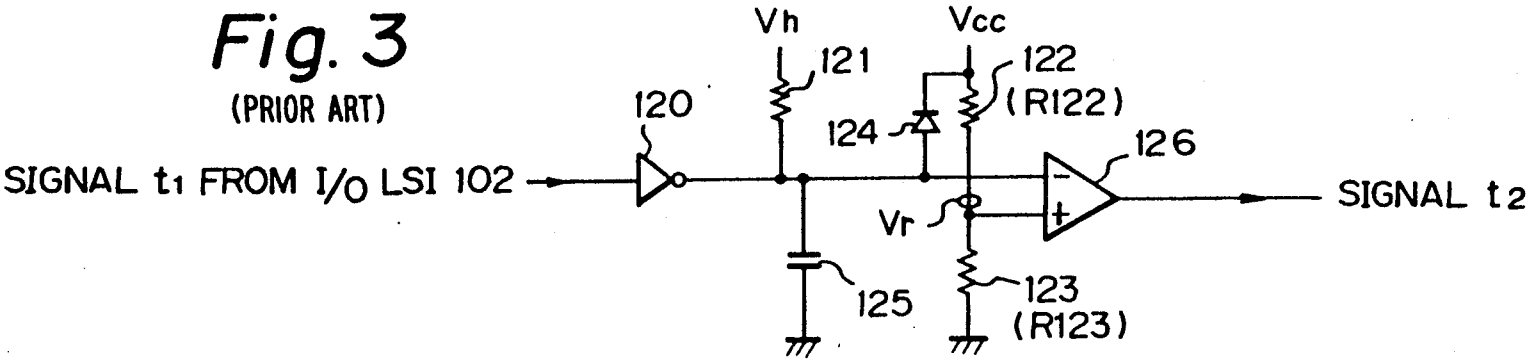
Fig. 3 (PRIOR ART)
FIG. 3 is a circuit diagram of a timer circuit of FIG. 1.
Figure 4:
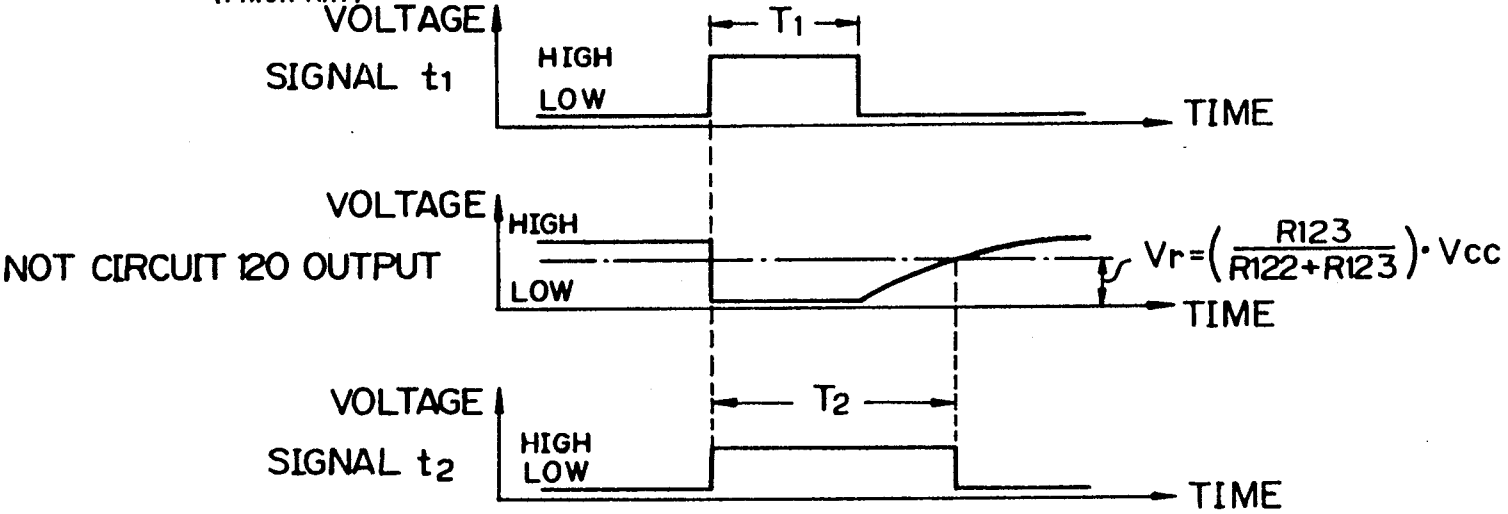
Fig. 4 (PRIOR ART)
FIG. 4 is a waveform daigram of the operation of FIG. 3.
Figure 5:
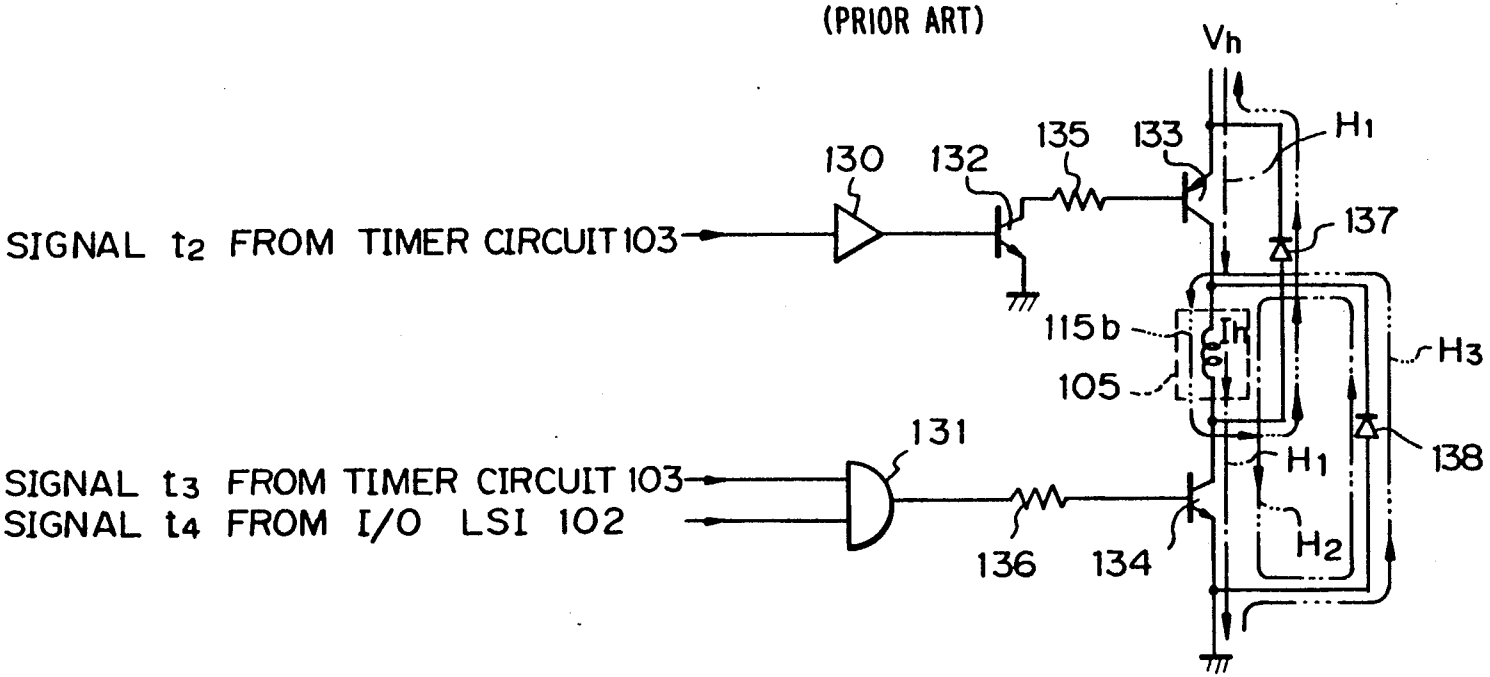
Fig. 5 (PRIOR ART)
FIG. 5 is a circuit diagram of a head driver of FIG. 1.

The present embodiment of the present invention having the arrangement as set forth above is different from the prior art shown in FIG. 1 in that the present embodiment has the variation detection means 8 and the flight time detection circuit 9, and in respect of the content of the control by the CPU 2. Accompanied by the arrangement, the arrangement of the wire-dot printing head 7 is different from that of FIG. 2. Although the timer circuit 4 is the same as the prior art timer circuit, the timer circuit of the prior art is arranged in the manner that the timer circuit may be standardized for setting the drive timing of all the printing wires with a single timer circuit while the timer circuit of the present invention may not be standardized but provided in individual print wire. Since the other arrangement of the present invention is same as that of the prior art, the explanation thereof is omitted but the arrangment different from that of the prior art will be described hereinafter.

Figure 9:
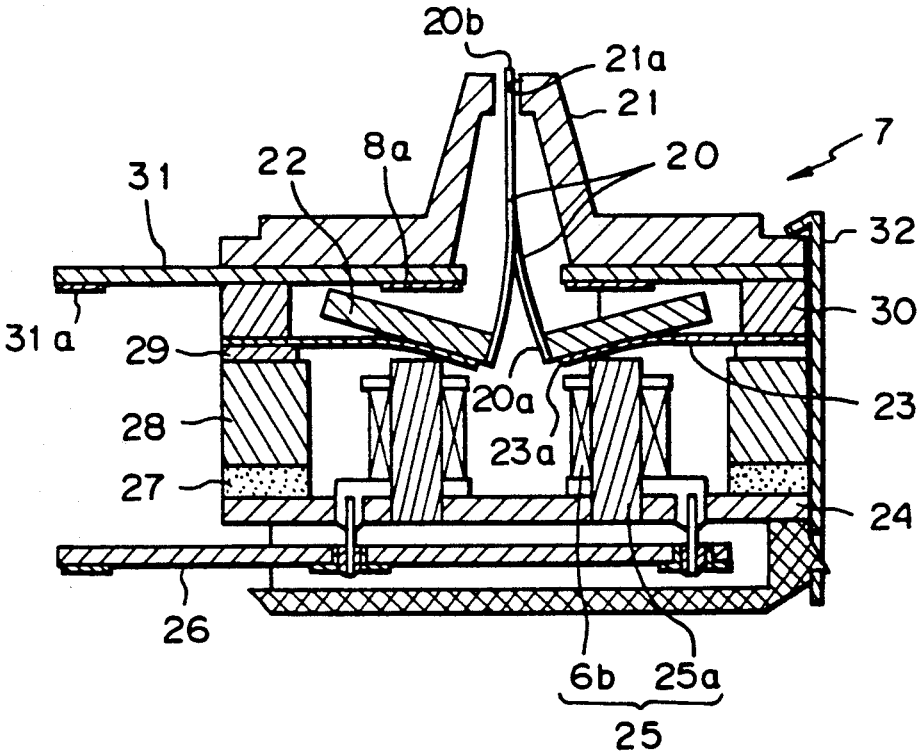
FIG. 9 is a longitudinal cross sectional view of a wire-dot printing head according to an embodiment of the present invention.

An arrangement of the wire-dot printing head 7 will be described first. FIG. 9 is a longitudinal cross sectonal view of the wire-dot printing head 7. In the same figure, designated at 20 is a plurality of printing wires provided in the wire-dot printing head 7 (two print wires are illustrated in the same figure), 21 is a guide frame having a guide groove 21*a* for guiding the printing wires 20, 22 are armatures each composed of a magenetic material, 23 are plate springs for supporting the armatures 22, 24 is a base plate, 25 is an electromagnet having a core 25a and a head coil 6*b* wound around the core 25*a*, 26 is a printed circuit board having a printed circuit for supplying a power supply to the electromagnet 25 and a connector terminal, 27 is a permanent magnet, 28 is a rack, 29 is a spacer, 30 is a yoke, 31 is a printed circuit board, and 32 is a clamp. The clamp 32 presses and holds the base plate 24, the permanent magnet 27, the rack 28, the spacer 29, the plate spring 23, the yoke 30, the printed circuit board 31, the guide frame 21 in a manner such that these members are laid one on another in turn and integrated.

The armature 22 is supported at the side of a free end 23*a* of the plate spring 23 while a base end 20*a* of one of the printing wires 20 is fixedly mounted on a distal end 22*a* of the armature 22. A distal end 20*b* of the printing wire 20 is guided by the frame groove 21*a* of the guide frame 21 so as to strike a predetermined position of the printing paper (not shown).

Figure 10:
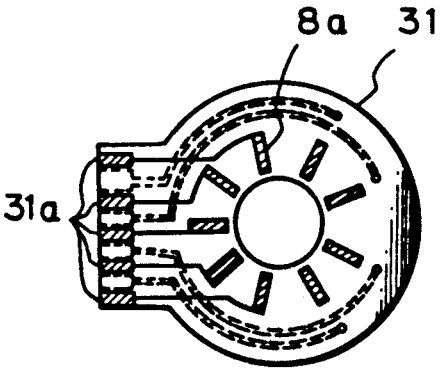
FIG. 10 is a plan view of a printing substrate.
Figure 11:
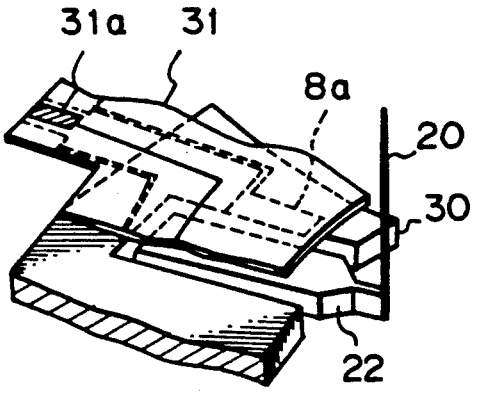
FIG. 11 is a perspective view showing a main portion of the printing substrate.

FIG. 10 is a plan view of,the printed circuit board 31, and FIG. 11 is a perspective view of the main portion of the printed circuit board 31. As illustrated in the same figures, the printed circuit board 31 of the present embodiment has sensor electrodes 8*a* made of a copper foil and positioned in a contronted relation with the armature 22 which sensor electrodes 8*a* are connected to connecter terminals 31*a* provided at the end of the printed circuit board 31 in accordance with the printed circuit. The printed circuit board 31 is coated by an insulating film for maintaining insulation from the yoke 30. Accordingly, there generates an electrostatic capacitance between the sensor electode 8*a* and the armature 22 and the capacitance value becomes smaller when the interval between the sensor electrode 8*a* and the armature 22 is larger while the capacitance value becomes greater when the interval between the sensor 8*a* and the armature 22 is smaller.

With the wire-dot printing head 7 having the arrangement as set forth above, when the head coil 6*b* is deenergized, the armature 22 is attracted to the side of the base plate 24 (downward direction in the figure) by the attraction force of the permanent magnet 27 against the resilience force of the plate spring 23. When the head coil 6*b* is energized, a magnet flux of the permanent magnet 27 is cancelled by the magnet flux of the electromagnet 25 to release the armature 22 from the attraction force of the permanent magnet 27 to move the armature 22 toward the side of the guide frame 21 (upward direction in the same figure) by the resilience force of the plate spring 23. Hereupon, the yoke 30 constitutes a part of the magnetic circuit prepared by the electromagnet 25 and functions to stop the mutual interference of the sensor electrodes 8*a*.

Figure 12:
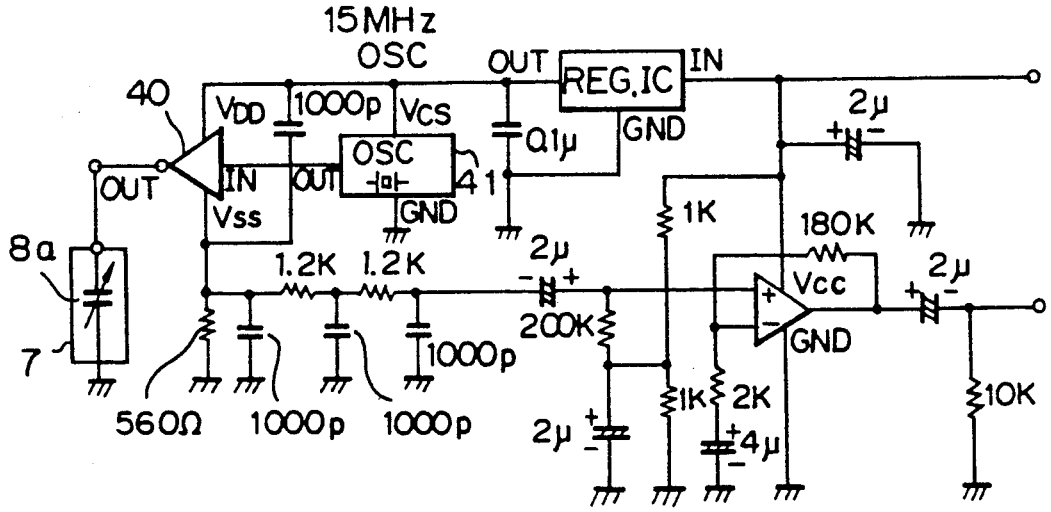
FIG. 12 is a circuit diagram of an electrostatic capactior sensor circuit.
Figure 13:
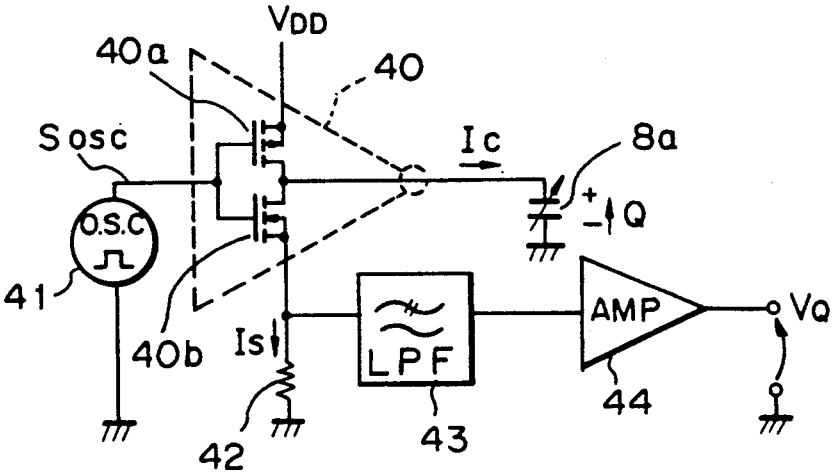
FIG. 13 is a view explaining a principle of the operation of FIG. 12.
Figure 14:
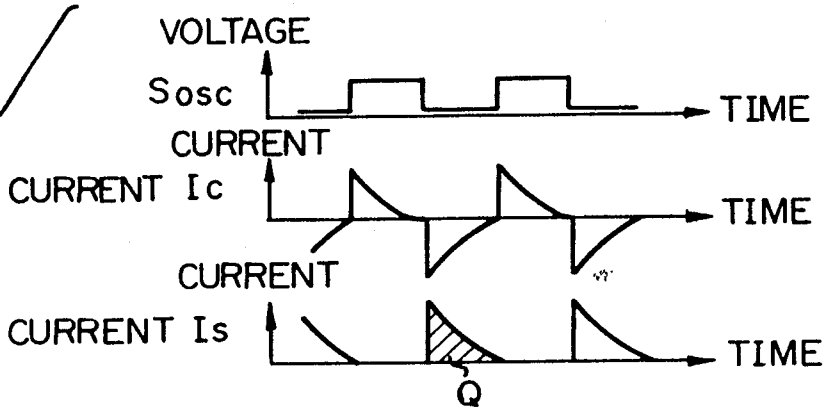
FIG. 14 is a waveform diagram of the operation of FIG. 13.
Figure 15:
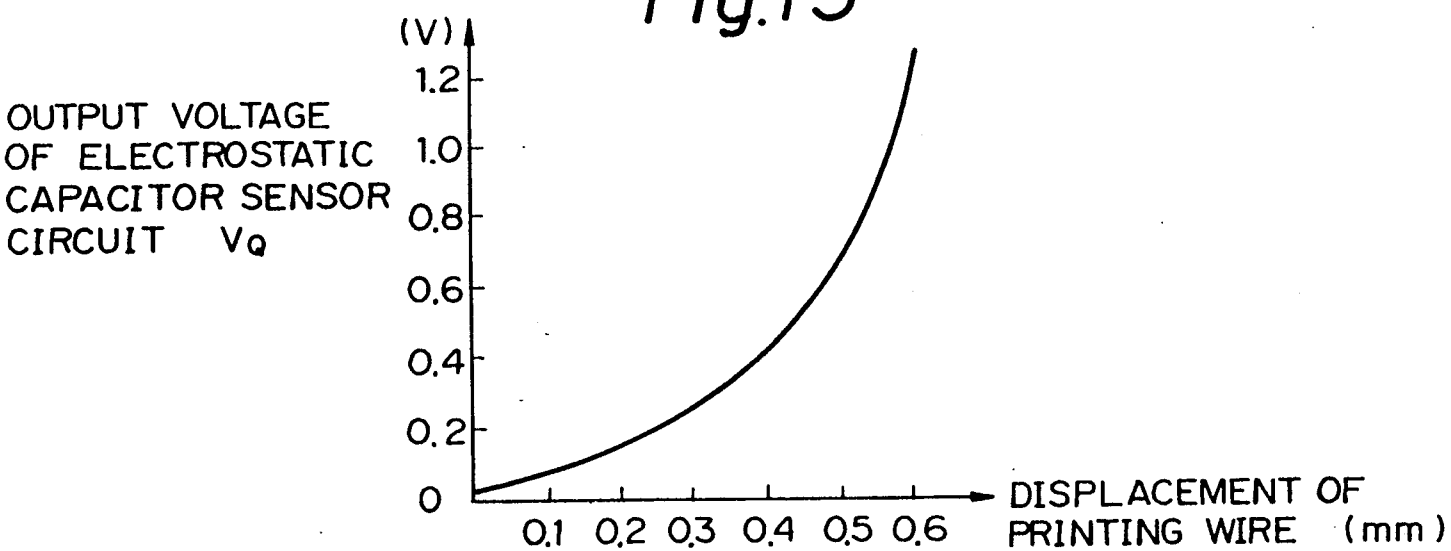
FIG. 15 is a graph showing variations of the output of the electrostatic capacitor sensor circuit relative to a displacement of a printing wire.

The displacement detection means 8 for detecting the displacement of the printing wire 20 will be described next. FIG. 12 is a circuit diagram of the sensor circuit 8*b*, FIG. 13 is a view for explaining a principle of FIG. 12, FIG. 14 is a waveform diagram of the operation of FIG. 13. In FIG. 13, designated at 40 is a digital IC (MSM74HCU04 of Oki Electric Industry Co., Ltd.), 40*a*, 40*b* are MOSFET of internal equivalent circuits (field effect transistor). Designated at 41 is an oscillator, 42 is a resistor, 43 is an integrator, and 44 is an ac amplifier. With the circuit set forth above, the sensor electrode 8*a* is connected to an output terminal of the digital IC 40 while a square shaped signal $S_{OSC}$ shown in FIG. 13 from the oscillator is applied to the input terminal of the digital IC 40 for thereby permitting a current $I_C$ to flow at the output terminal of the digital IC 40. The current $I_C$ is a charging/discharging current to be supplied to the sensor electrode 8*a* so that the FETs 40*a*, 40*b* are alternately turned on or off on the reception of the signal $S_{OSC}$. The discharging current $I_S$ flows to ground via the FET 40*b*, the resistor 42. A value of the integration of the discharging current $I_S$ for one periodic cycle corresponds to quantity Q of an electric charge to be substahtially charged in the sensor electrode 8*a*. Assuming that an electrocapacitance of the sensor electrode 8*a* is $C_X$, an oscillation frequency of the oscillator 41 is f, a resistance value of the resistor 42 is $R_S$, and an amplification factor of the amplifier 44 is a, the mean value of the current $I_S$ will be $f \cdot Q = f \cdot C_X \cdot V_{DD}$ while the output voltage of the amplifier will be $V_Q = C_X \cdot R_S \cdot a \cdot f \cdot V_{DD}$ whereby the desired voltage $V_Q$ proportional to the electrocapacitance $C_X$ is produced. However, actually the amplifier 44 is composed of an ac amplifier so that the offset (dc) such as the distribution capacitance etc. existing other than the sensor electrode 8*a* is cut off and only the displacement of the printing wire 20 is produced. Accordingly, the relationship between the displacement of the printing wire 20 and the output voltage $V_Q$ of the sensor circuit 8*b* is illustrated in a graph of FIG. 15 since the electrostatic capacitance of the sensor electrode 8*a* is approximately inverse proportional to the distance between the sensor electrode 8*a* and the armature 22.

Figure 16:
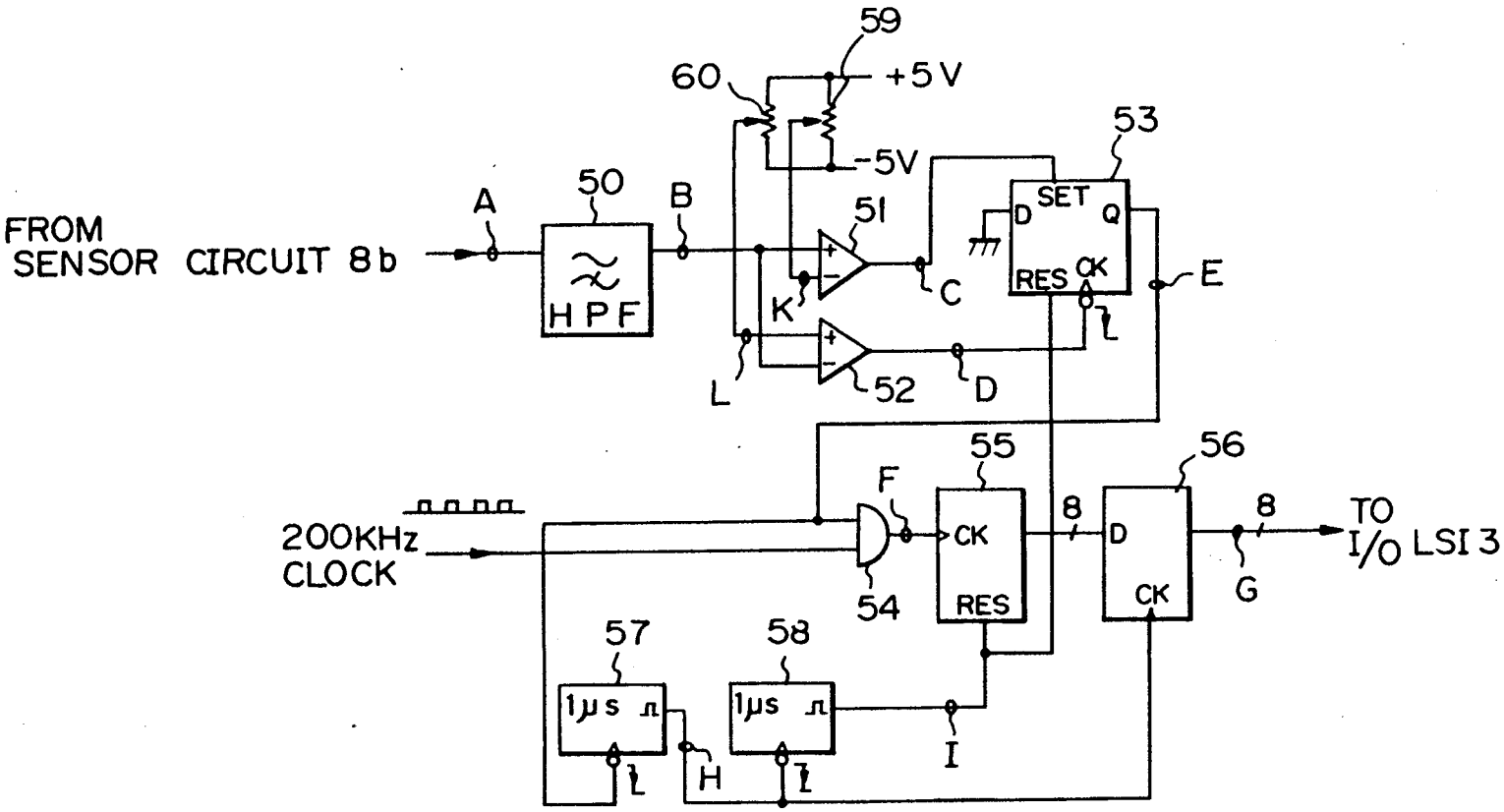
FIG. 16 is a block diagram of a flight time detection circuit.
Figure 17:
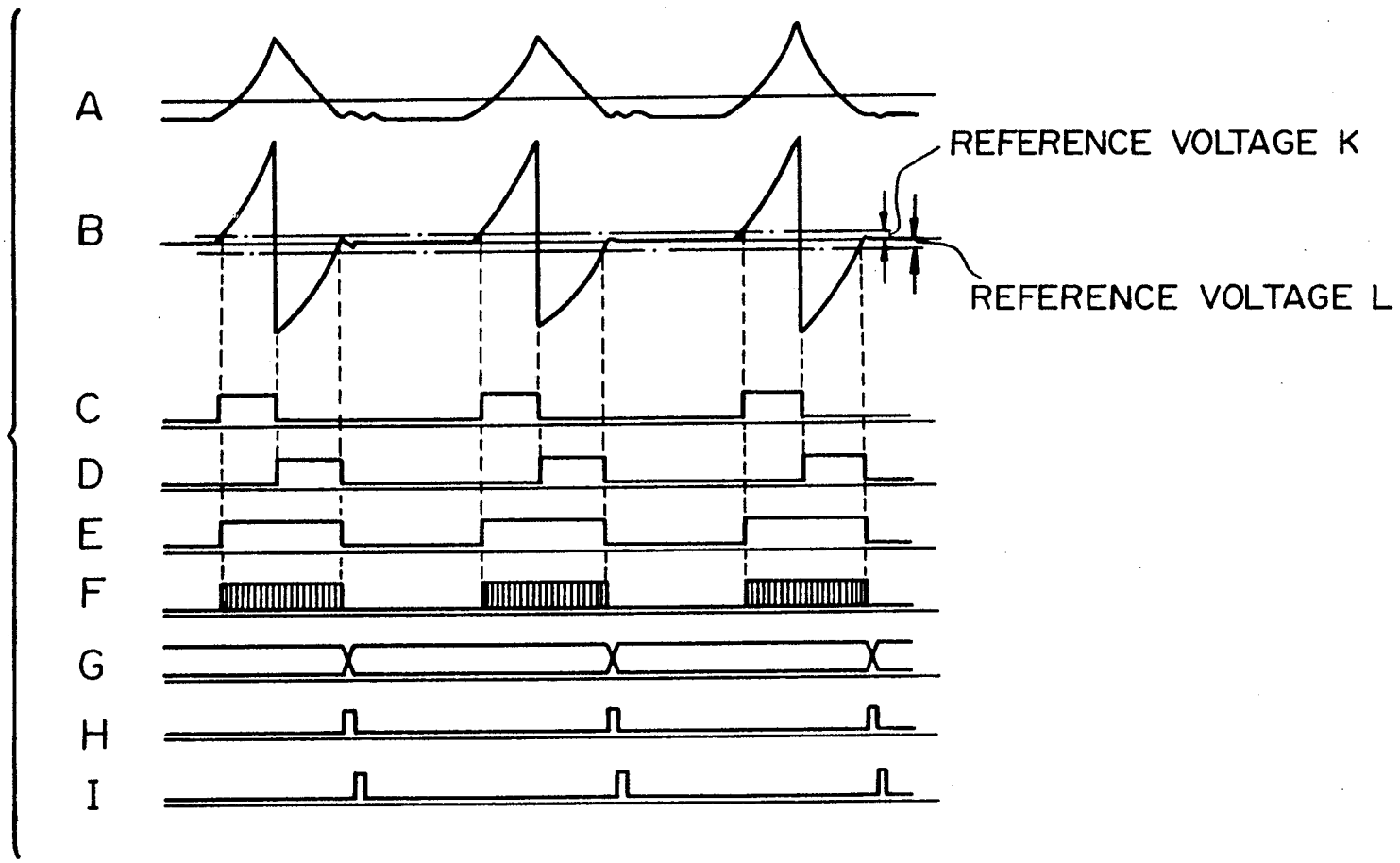
FIG. 17 is a waveform daigram of the operation of FIG. 16.
Figure 18:
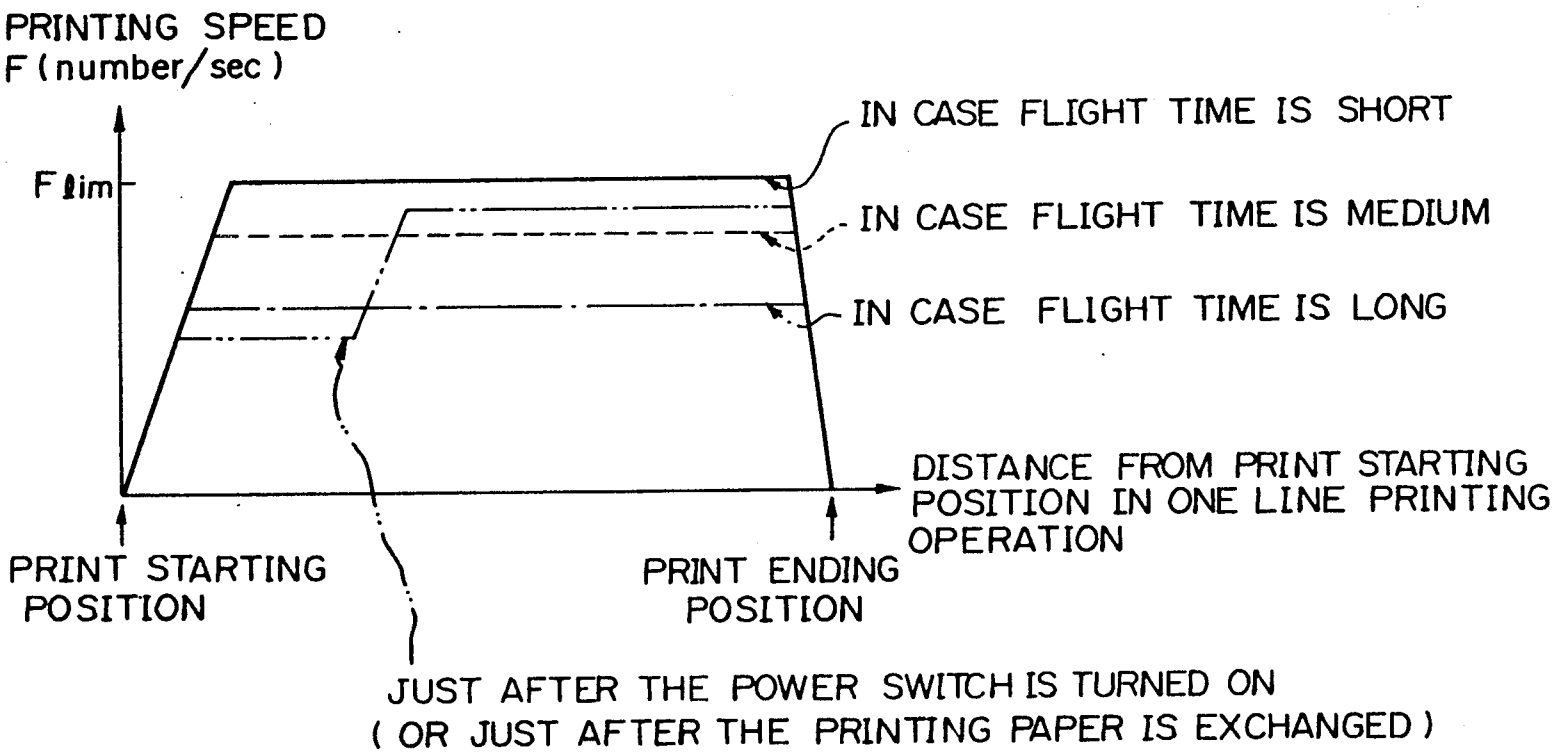
FIG. 18 is a graph showing variations of the printing speed in the printing interval of one line according to the embodiment of the present invention.

Next, the flight time detection circuit 9 will be described. FIG. 16 is a block diagram of the flight time detector circuit 9 and FIG. 17 is a waveform diagram of the operation of the flight time detector circuit 9. In the same figures, designated at 50 is a differentiator, 51, 52 are comparators, 53 is a D flip-flop circuit, 54 is an AND circuit, 55 is a 8-bits binary counter, 56 is a D latch, 57, 58 are one-shot multivibrator (hereafter referred to as multivibrator), and 59, 60 are variable resistors. With the arrangement set forth above, the differentiator 50 receives a signal A from the sensor circuit 8*b*. The signal A is differentiated by the differentiator 50 and changed to a signal B while the comparator 51 compares a comparator voltage K produced by the variable resistor 59 with a voltage of the signal B to produce a signal C. The comparator 52 compares a comparator voltage L produced by the variable resistor 60 with a voltage of the signal B to produce a signal D. The signals C, D will be 5 V at high level and while 0 V at low level and supplied to an input set and an input Clock of the D flip-flop circuit. Hence, at the output terminal Q of the D flip-flop circuit 53 an output signal E goes high level at the time when the signal C goes to high level, and goes low level at the time when the signal D goes to low level. The signal E, in the displacement of the printing wire as illustrated in the waveform of the signal A, keeps a high level from actuation of the printing wire until returning to the original position after qtriking the printing medium. The signal E and the clock signal of 200 kHz are applied to the AND circuit 54 where they are ANDed and an AND signal F is applied to an input Clock of the counter 55. Hence, the counter 55 is counted up every 5 μs during the time signal E maintains a high level which value corresponds to a flight time. The signal E is also applied to the inversed time 1 μs multivibrator 57 output H of which are applied to the inversed time 1 μs multivibrator 58 and an input Clock of the latch 56. When a trailing edge of the signal H is being detected by the multivibrator 58, a signal I which returns to the original level after a period of time of 1 μs is produced from the multivibrator 58 and applied to the reset input of the counter 55 and the reset input of the D flip-flop circuit 53. Accordingly, the D latch 56 latches the count value of the counter 55 just after the signal E goes to a low level and resets the counter 55 for preparation of the counting thereof. Hence, a value corresponding to the flight time will be latched in the D latch 56 and is renewed at all times. This value can be read out by the CPU 2 via the I/O LSI 3 at the arbitrary timing.

The control of the CPU 2 will be described next. The control of the CPU 2 according to the embodiment of the present invention has, in addition of the prior art function, a function to read out the flight time detected by the flight time detector circuit 9 and to vary the print repetetive cycle on the basis of the flight time, Assuming that the print repetetive period is T (sec), the print speed is F (number/sec), the expression $F=1/T$ is established. Accordingly, the control of the print repetetive period will be described hereinafter as the control of the printing speed.

In the prior art apparatus, assuming that the nominal printing speed is Fn (number/sec), the speed F at the head of the line is in general not expressed as $F=Fn$ but $F<Fn$. With progress of the printing of the several characters, the print speed F is increased and at the time the expression $F=Fn$ is established, the printing can be effected at the prescribed printing speed Fn. At the end of the line, the printing speed is reduced from the letter which is positioned before several letters counting from the last letter. The ratio the of increase and decrease of the speed is determined by a capacity of the spacing motor capable of moving the wire-dot printing head in the line direction and such operation has been made due to inertia peculiar to the mechanism.

According to the embodiment of the present invention, the maximum speed of the printing speed F is variable corresponding to the flight time. Let us describe here the deriving process of the flight time in the case of nine print wires. That is, the CPU 2 selects the maximum flight time TFn assuming that the flight times of each printing wire 20 obtained by one time printing operation are TF1, TF2, . . . , TF9 (n is an integer which is above 1 but below 9), and these are considered as TF. Provided that there are m numbers of TFk are observed in one line printing operation, the average value TFa of TF1, TF2, . . . , TFm is obtained from the following expression.

$$TFa = \frac{1}{m} \sum_{k=1}^{m} TFk$$

wherein the value of m is arbitrary since the number of m does not always accord with the number of printed letters in one line and the number of printed letters in each line is not always constant depending on the speed of execution of the CPU 2 and other processing amount to be executed simultaneously because the CPU 2 reads out the flight time in the interval between the present printed letter and the letter to be printed next.

This is explained in more detail with a specific example. Assuming that the maximum printing speed is Fmax (time/sec), the maximum value of the priting speed determined by the capacity of the wire-dot printing head is Flim(time/sec), Fmax can be obtained from the following expression. That is, in case that $Fmax<Flim$, $$Fmax=1/\{TFa \times (5\times 10^{-6})+Co\};$$

in case that $Fmax<Flim$;

$$Fmax=Flim;$$

wherein $(5\times 10^{-6})$ is a conversion constant in case that the clock of the number of flight time circuit is 200 kHz, and Co is a float in view of the variation of the characteristic of the wire-dot printing head. According to the present invention, Co is expressed as $Co=10\times 10^{-6}$ (sec) but is variable depending on the printing condition.

At the first line printing just after the power switch is turned on or just after the printing paper is exchanged, the several printing operations are effected just after the actuation of the printing operation while the value of Fmax is set to $(\frac{1}{2})\times Flim$. After the value of the Fmax is determined, the printing speed is accelerated until the observed Fmax of the flight time.

With the arrangement of the embodiment of the present invention, the displacement detector means detects the displacement of the printing wire. The flight time detector cirucit detects the flight time on the basis of the detected displaced signal. The control means calculates the average of the flight time every printing of one letter and sets the print repetetive period of the print wire 20 in the next line to an appropriate value. That is, the controller can control to provide the print repetetive period which is insufficient1y long within which the printing wire can strike the printing medium to obtain a clear printed letter with sufficient strength.

Figure 19:
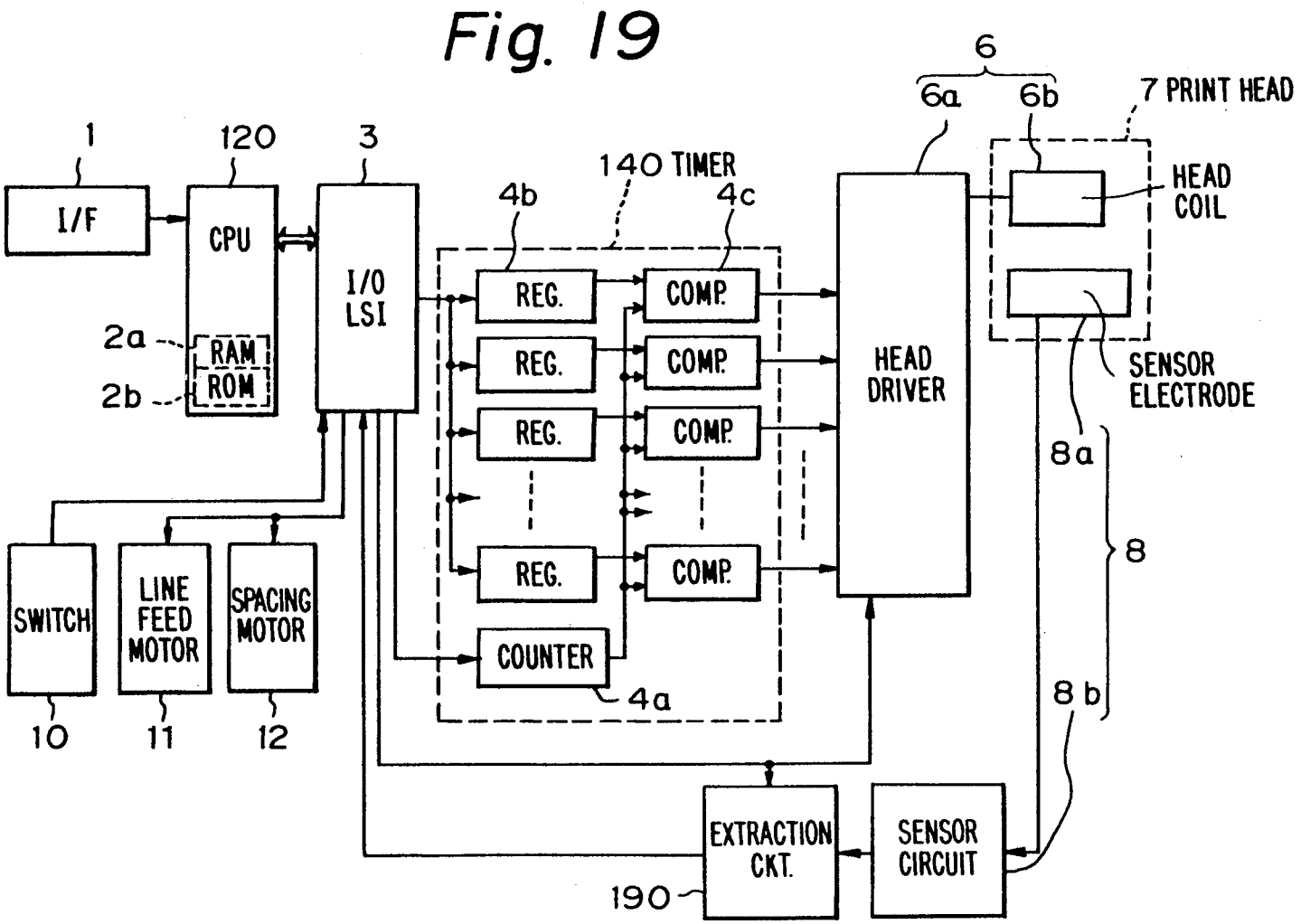
FIG. 19 is a block diagram of a wire-dot impact printer according to another embodiment of the present invention.

FIG. 19 is a block diagram of a wire dot impact printer of another embodiment of the present invention. In the same figure, designated at 120 is a CPU as a controller for controlling the operation of the whole of the present apparatus and has inside thereof a RAM 2*a* and ROM 2*b* (read only memory) as a memory. Designated at 140 is a timer circuit having a plurality of registers 4*b* and comparators 4*c*. Designated at 190 is a characteristic extraction circuit (characteristic extraction means) for detecting the time counting from when the head driver 6*a* received an printing actuation instruction until the printing wire can operate and the maximum displacement of the printing wire. The other arrangements are same as those explained in FIG. 8. According to this embodiment, the CPU 120 receives the print data via the centro I/F 1 and supplies the signal issued from the print data to the timer circuit 140, the head driver 6, the line feed motor 11, and the spacing motor 12 via the I/O LSI 3. The head driver 6*a* drives the wire-dot printing head 7 to effect the printing operation on the basis of the signals received from the CPU 120 and the timer circuit 140.

This embodiment having the arrangement set forth above is different from the prior art as illustrated in FIG. 1 in that this embodiment has the timer circuit 140 and the characteristic extraction circuit 190 and in respect to the different contents of control to be made by the CPU 120 provided with ROM26. Accompanied by these differences, the arrangement of the wire-dot printing head 7 is different from that of FIG. 2. Other arrangements are fundamentally the same as those of the prior art or those of a first embodiment of FIG. 8.

Hence, the explanation thereof is omitted and the different arrangements will be described.

Figure 20:
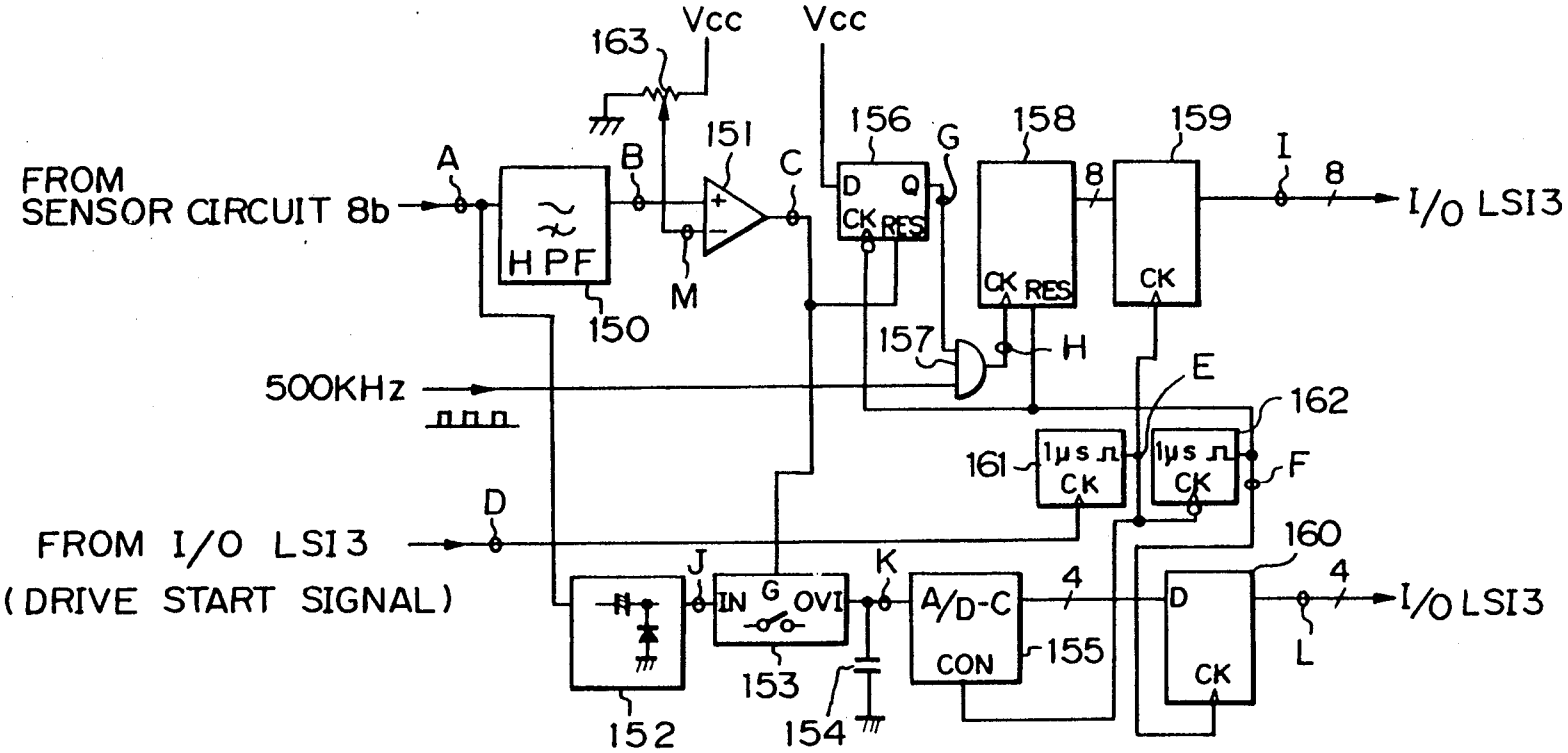
FIG. 20 is a block diagram of a characteristic extraction circuit.
Figure 21:
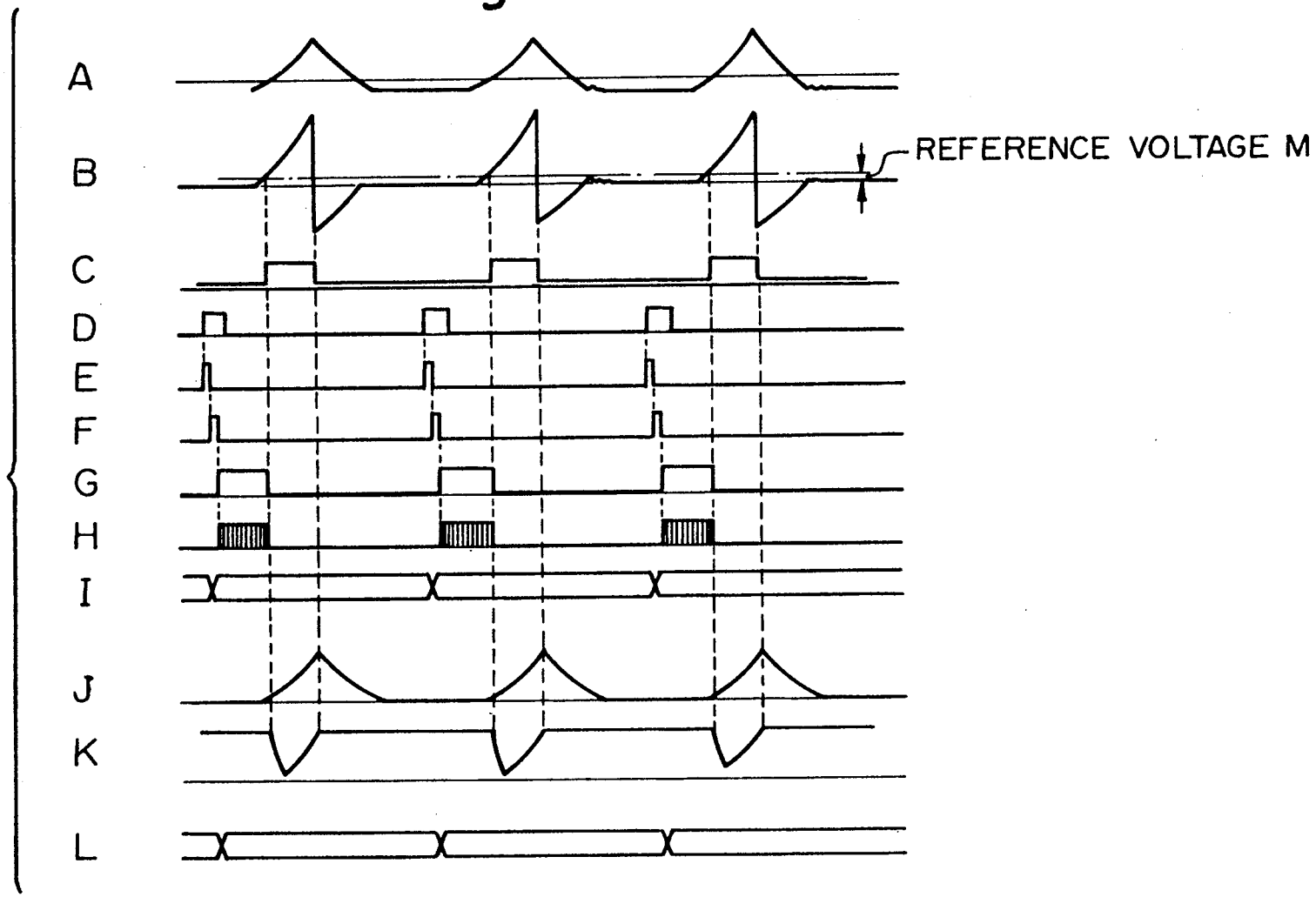
FIG. 21 is a waveform daigram of the operation of FIG. 20.

The characteristic extraction circuit 190 will be described first. FIG. 20 is a block diagram of the characteristic, extraction circuit 190 and FIG. 21 is a waveform diagram of the operation of the characteristic extraction circuit 190. In the same figures, designated at 150 is a differentiator, 151 is a comparator, 152 is a clamping circuit, 153 is an analog switch, 154 is a hold capacitor, 155 is a 4-bit A/D converter, 156 ,is D flip-flop circuit, 157 is an AND circuit, 158 is an 8-bit binary counter, 159 is an 8-bits, D latch, 160 is a 4-bit D latch, 161, 162 are one-shot multivibrators (hereafter referred to as multivibrator), and 163 is a variable resistor. With the arrangement set forth above, the differentiator 150 receives a signal A from the sensor circuit 8*b*. The signal A is differentiated by the differentiator 150 and produced as a signal B while the comparator 151 compared a comparator voltage M produced by the variable resistor 163 with a voltage of the signal B to produce a signal C. The signal C will be 5 V at high level and 0 V at low level. The signal C is supplied to an input Reset of the D flip-flop circuit 156 and to an input Gate of the analog switch 153.

Hereupon, a drive start signal D showing a drive actuation is applied to the inverse time 1 μs multivibrator 161 from the I/O LSI 3. The multivibrator 161 starts to operate after detecting the leading edge of the signal D and issues a signal E which is inversed 1 μs later. The signal E is applied to an input Clock of the D latch 159, an input Clock of the inverse time 1 μs multivibrator 162 and to an input convert actuation timing of the A/D Converter 155. The multivibrator 162 receives the signal E as a trigger signal and starts to operate after detecting the trailing edge of the signal E to thereby issue a signal F which is inversed after 1 μs later and supplied to an input Clock of the D flip-flop circuit 156, an input Reset of the counter 158 and input Clock of the D latch 160.

Accordingly, at the time when the drive start signal D goes to high level, the multivibrator 161 is inverted to thereby permit the D latch 159 to latch the value of the counter 158. The multivibrator 162 is inverted, just after latching of the D latch 159, to reset the counter 158 and set the D flip-flop circuit 156 at the same time. The AND circuit 157 receives a signal G issued from an output Q of the D flip-flop circuit 156 and a clock of 500 kHz which are applied to the AND circuit and are ANDed to produce an AND signal H which is applied to an input Clock of the counter 158. Hence, the D flip-flop circuit 156 is set and the counter 158 counts the signal H at the time when the signal G keeps high level.

Hereupon, the D flip-flop circuit 156 is reset and the signal G is inverted to the low level when the output signal C of the comparator 151 rises up to high level. The rising and the dropping of the signal C corresponds to an operation position of the printing wire 20. That is, the time when the signal C rises accords with the time when the printing wire 20 starts to operate while the time when the signal C drops accords with the time when the printing wire 20 strikes the printing paper. Accordingly, the output signal G of the D flip-flop circuit 156 keeps high level during the period from the application of the drive start signal D until the actuation of the printing wire 20, and the counter 158 counts the period. The counted value is latched by the D latch 159 just after the application of the drive start signal D, and the value of the counter 158 is cleared after latching. The value latched by the D latch 159 is supplied to the I/O LSI 3 as a 8-bits signal I and read by the CPU 120. A time resolution of the count value is 2 s.

The signal A is applied also to the clamping circuit 152 and dc of the output J of the clamping circuit 152 is regenerated as illustred in FIG. 21 and the lower end of the waveform is clamped to 0 V. The output J is applied to the analog switch 153 which is open or closed by the output C of the comparator 151 while the output K of the analog switch 153 is applied to an input terminal of the A/D converter 155 connected to the hold capacitor 54. The analog switch 153 is turned on when the signal C is in high level during which time the hold capacitor 154 is charged. At the time when the signal C is returned to low level, the analog switch 153 is turned off so that the voltage of the signal K is stored by the hold capacitor 154. Since the time when the analog switch 153 is turned off coincides with the time when the displacement of the printing wire 20 is maximized, an up-to-date maximum value (latest head gap data) is at all times stored in the signal K. The multivibrators 161, 162 are successively inverted by the next drive start signal D for thereby issuing the convert starting signal to the A/D converter 55 and then issuing a clock signal to the D latch 160. An output value of the D latch can be read out by the CPU 20 via the I/O LSI 3. According to this embodiment, each printing wire is provided with the circuit of FIG. 20 and the maximum data about the displacement for each printing wire is obtained during the period between the actuation of driving and the actuation of printing.

Figure 6:
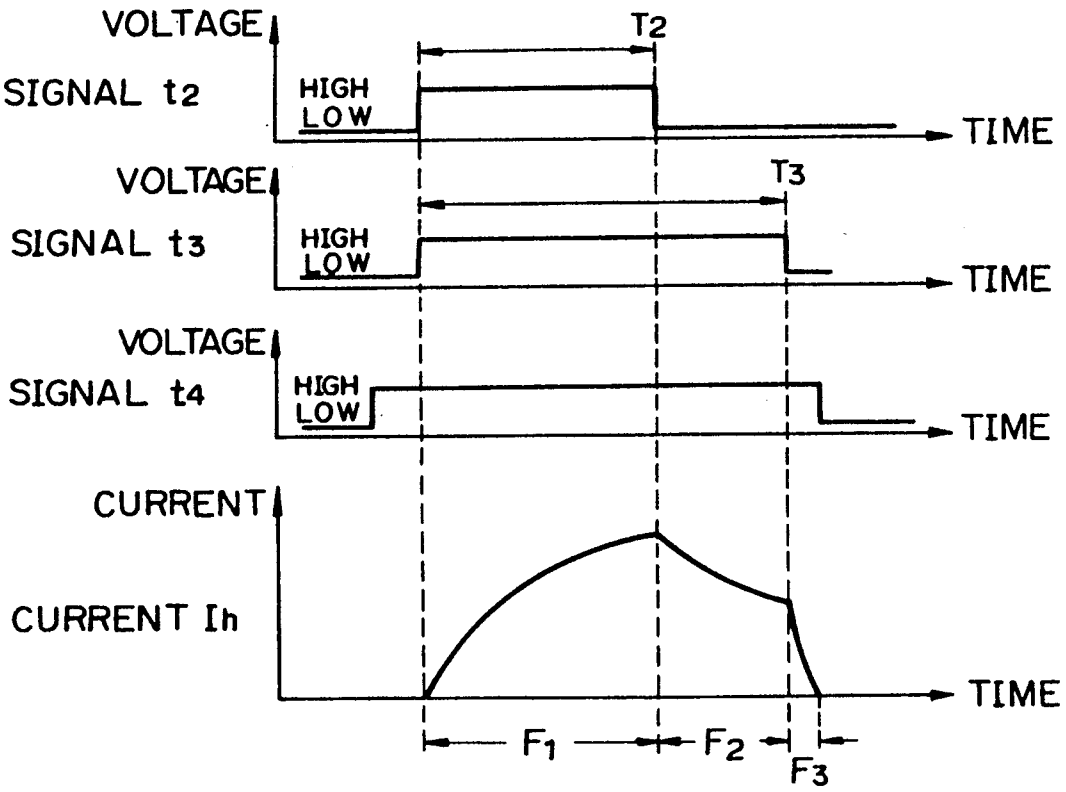
Fig. 6 (PRIOR ART)
FIG. 6 is a waveform diagram of the operation of the head driver of FIG. 5.
Figure 7:
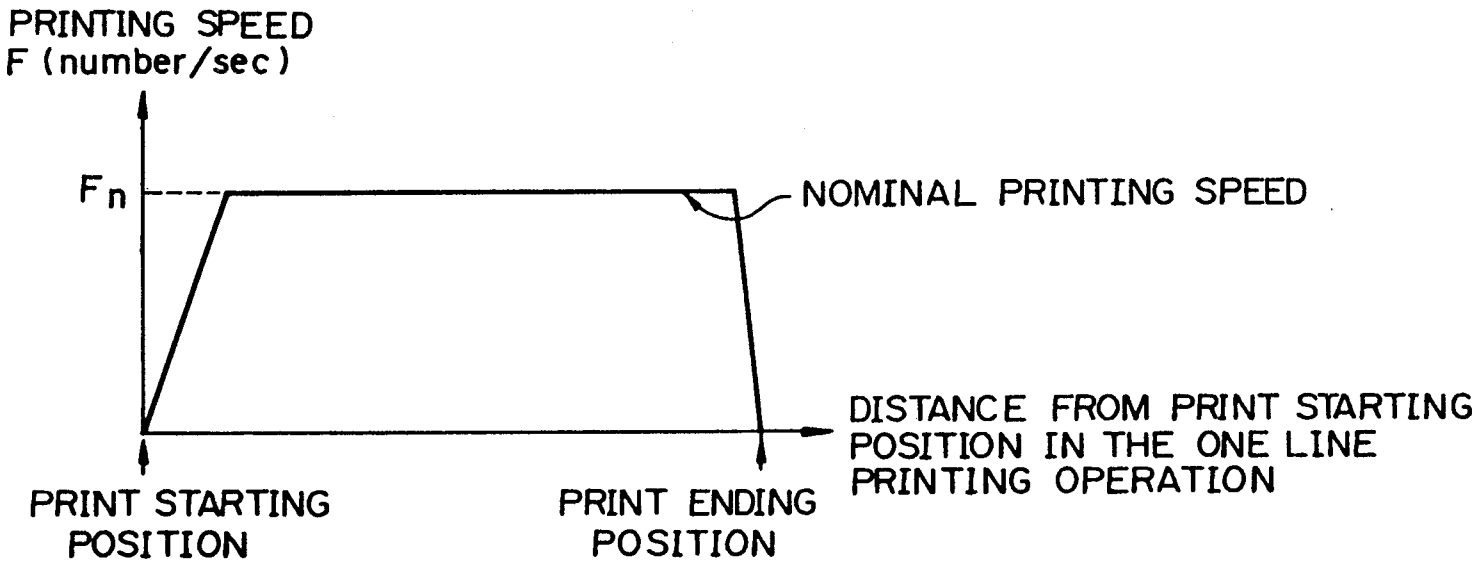
Fig. 7 (PRIOR ART)
FIG. 7 is a graph showing variations of printing speed in the printing interval of one line in the piror art.

The timer circuit 140 will be described with reference to FIG. 19. The timer circuit 140 comprises, as shown in the same figure, a counter 4*a*, a group of registers 4*b* and a group of comparators 4*c* wherein the counters are counted up one by one in a prescribed period (2 μsec) counting from 0 by the counter 4*a*, while the registers 4*b* set the timer value individually for each printing wire 20. The comparators 4*c* and the values of the registers 4*b* and the values of the counter 4*a*, and output drive signal $t_2$ (FIG. 6) to the head driver 6*a*. Thus, drive signal $t_2$ goes from "LOW" to "HIGH" when the value of the counter 4*a* is reset to zero (0), and goes from "HIGH" to "LOW" when the value of the counter 4*a* exceeds the value of the registers 4*b*.

A process for determining an optimum correction value by the CPU 120 will be described.

There are an overdrive signal and an enable signal for each printing wire 20 as the value to be determined by the timer cicuit 140. The determination of the overdrive signal is first described hereinafter. A table showing a timer correction value in FIG. 22 is stored in the ROM 2*b* of the CPU 120 and comprises four tables, namely, a correction number Cl for the number of printing wires effecting simultaneous printing as shown in the same figure (a), a correction number C2 for a past record (number of printing wires effecting previous printing) as shown in the same figure (b), a correction number C3 for a head gap as shown in the same figure (c), and a correction number C4 for a variation of the printing wire as shown in the same figure (d). The correction numbers set forth above may be stored in the RAM 2*a* but according to the present embodiment they are supplied from a host unit (not shown). The correction number C1 for the number of printing wires effecting simultaneous printing corrects a power supply voltage drop and a magnetic interference with in the wire-dot printing head while the correction number C2 for the past record corrects an affection of the past printing record. The correction number C3 for the head gap corrects the variation of the head gap while the correction number C4 for the variation of the printing wire corrects the variation of period lasting from issuance of the drive instruction until actual actuation of the operation of the printing wire.

Inasmuch as the number of printing wires for effecting printing and the data of the past record of the previous printing during the period between the present printing operation and the next printing operation are known from the printing data obtained via the centro I/F, the correction number C1 for the number of printing wires. effecting simultaneous printing and the correction number C2 of the past record can be selected from the table stored in the ROM 2*b*.

It is possible to know the head gap data for each printing wire and operation time-current characteristic of the period lasting from actuation of driving until the actuation of the operation of the printing wire by reading out the values of the latch 159 and the latch 160 of the characteristic extraction circuit 190 whereby the correction number C3 for the head gap and the correction number C4 for the variation of the print wire can be selected by the table stored in the ROM 2*b*.

Inasmuch as the characteristic extraction circuit 190 according to the present embodiment have an 8-bit counter 159 and a 4-bit A/D converter, and a clock pulse of 500 kHz applied to the counter with a resolution of 2 μs, the timer correction table is prepared in view of this. The correction number C3 can be selected from the values 0 to 15 which are obtained by 4-bits resolution of head gap data stored in the D latch 160. The time data resolution stored in the D latch 159 is 2 μs and this value (standard value) is 100 (equivalent to 200 μs) since the present embodiment adopts the standard wire-dot printing head, the correction number C4 for variation of the printing wire is selected from the value obtained by reduction of 100 from the D latch. Since no printing operation is carried out before determining the correction numbers, the values in the D latches 159, 160 are void so that 0 is selected as the correction number.

According to the present embodiment provided with a standard wire-dot printing head, the value (equivalent to standard value) was 150 (equivalent to 300 μs), the timer value to be written in timer circuit becomes the value of the sum of C1+C2+C3+C4 plus 150.

As described above, the characteristic, extraction circuit 190 according to the present embodiment extracts, on the basis of the displacement data of the printing wire 20 issued by the sensor circuit 8*b*, the operation time-current characteristic for each printing wire 20 such as a time data for the period lasting from, application of drive actuation signal to the head driver until the actual actuation of operation of the printing wire 20 or time data for the period lasting from actuation of operation of the print wire 20 until striking the printing paper by the print printing wire. Since the ROM 2*b* stores preliminarily the correction table about the operation time-current characteristic in the manner of enabling to be read out, the CPU 2 reads out the appropriate correction number from the ROM 2*b* on the basis of the operation time-current characteristic extracted by the character extraction circuit 190 so that the CPU 120 can correct the operation time-current characteristic on the basis of the correction numbers and effects the next printing operation. Accordingly, inasmuch as all the printing wires operate dependent upon their own appropriate corrected operation time-current characteristics such problem of an inconveniences that the energy is insufficient for printing operation and an excessive energy more than required is supplied to the head coil 6*b* are solved.

According to this embodiment, the correction number is read out from the ROM on the basis of the resultant detection by the characteristic extraction circuit 190 and the operation time-current characteristic is controlled based on the correction number but the operation time-current characteristic can be controlled by an arithmetic operation.

Figure 23:
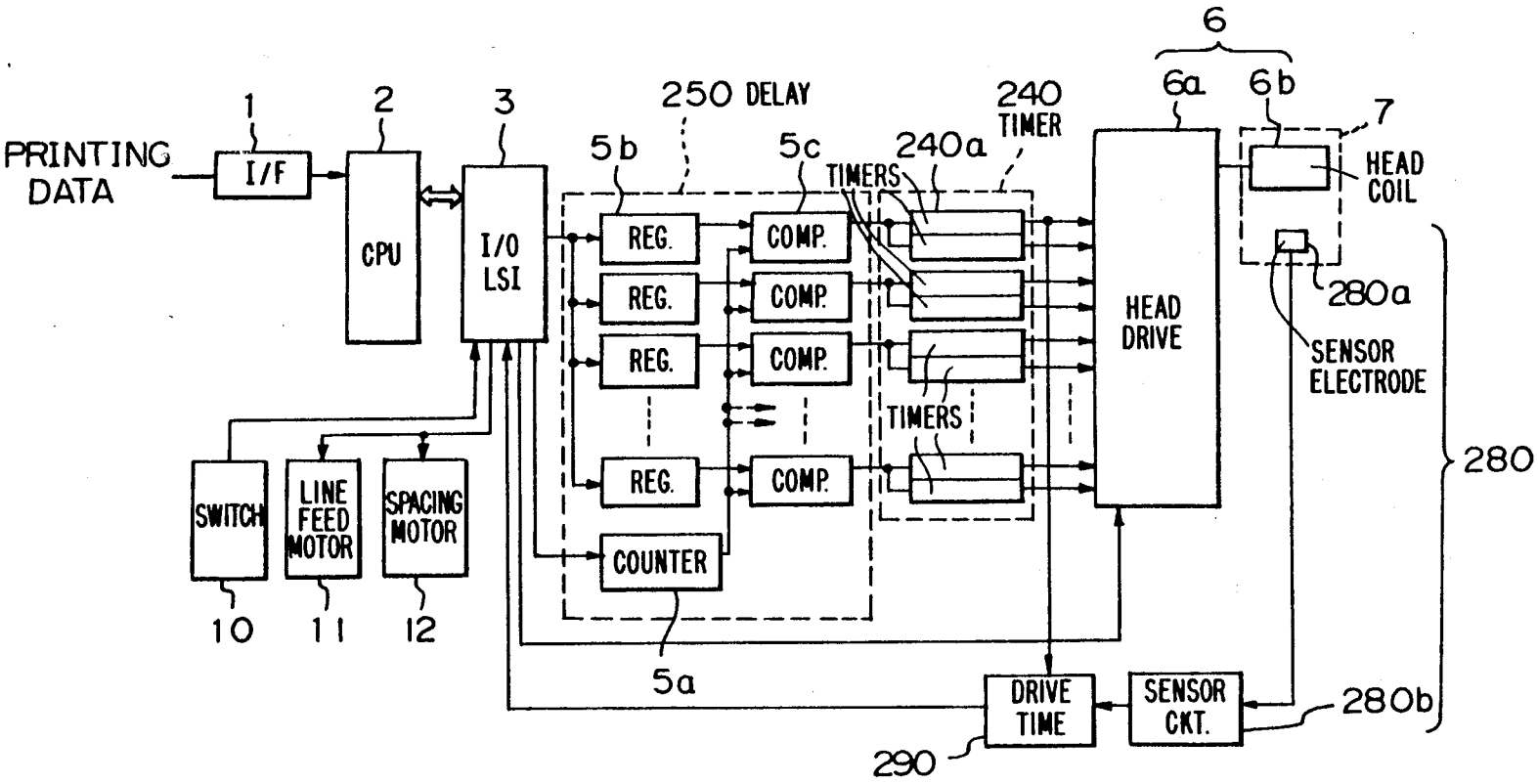
FIG. 23 is a block diagram of a wire dot impact printer according to still another embodiment of the present invention.

FIG. 23 is a block diagram of a wire dot impact printer according to another embodiment of the present invention. In the same figure, designated at 240 is a timer circuit, 250 is a delay circuit, and the timer circuit 240 and the delay circuit 250 function as a drive timing setting means. Designated at 280*a* is a sensor electrode, 280*b* is an electrostatic capacitor sensor circuit (hereafter referred to as sensor circuit), 280 is a print timing detector means composed of the sensor electrode 280*a* and the sensor circuit 280*b*, and 290 is a drive time detector circuit as the driving time detector means for detecting the drive time from application of the print starting instruction to the head driver 6*a* until the striking of the printing wire on the printing paper to effect printing. Other arrangements are the as those of FIG. 8. According to this embodiment, the CPU 2 receives the printing data via the centro I/F 1 and supplies the signal issued from the printing data to the delay circuit 250, the head driver 6*a*, the line feed motor 11, and the spacing motor 12 via the I/O LSI 3. The head driver 6*a* drives the printing wire of the wire-dot head 7 to effect printing operation on the basis of the signals received from the CPU 2 and the timer circuit 240.

This embodiment having the arrangement set forth above is different from the prior art as illustrated in FIG. 1 in that this embodiment has the delay circuit 250, the print timing detector means 280 and drive time detector circuit 290 and in respect to the different contents of control to be made by the CPU 120. Accompanied by these differences, the arrangement of the wire-dot printing head 7 is different from that of FIG. 2. Although the timer circuit 240 is same as the prior art timer circuit, the timer circuit of the prior art is arranged in the manner that the timer circuit may be standardized for setting the drive timing of all the printing wires with a single timer circuit while the timer circuit of the present invention may not be standardized but a timer circuit 240*a* is provided in each individual printing wire. Other arrangements are fundamentally same as those of the prior art or those of a first embodiment of FIG. 8. Hence, the explanation thereof is omitted and the different arrangements will be described.

Figure 24:
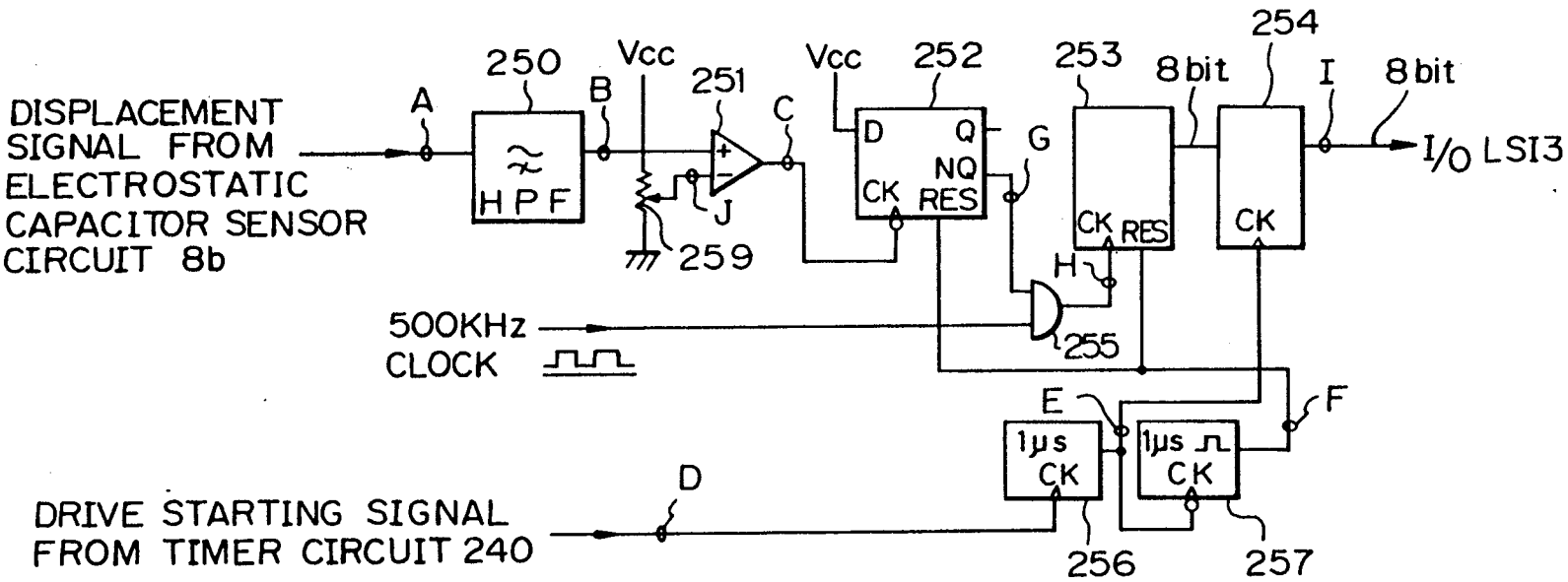
FIG. 24 is a block diagram of a drive time detection circuit.
Figure 25:
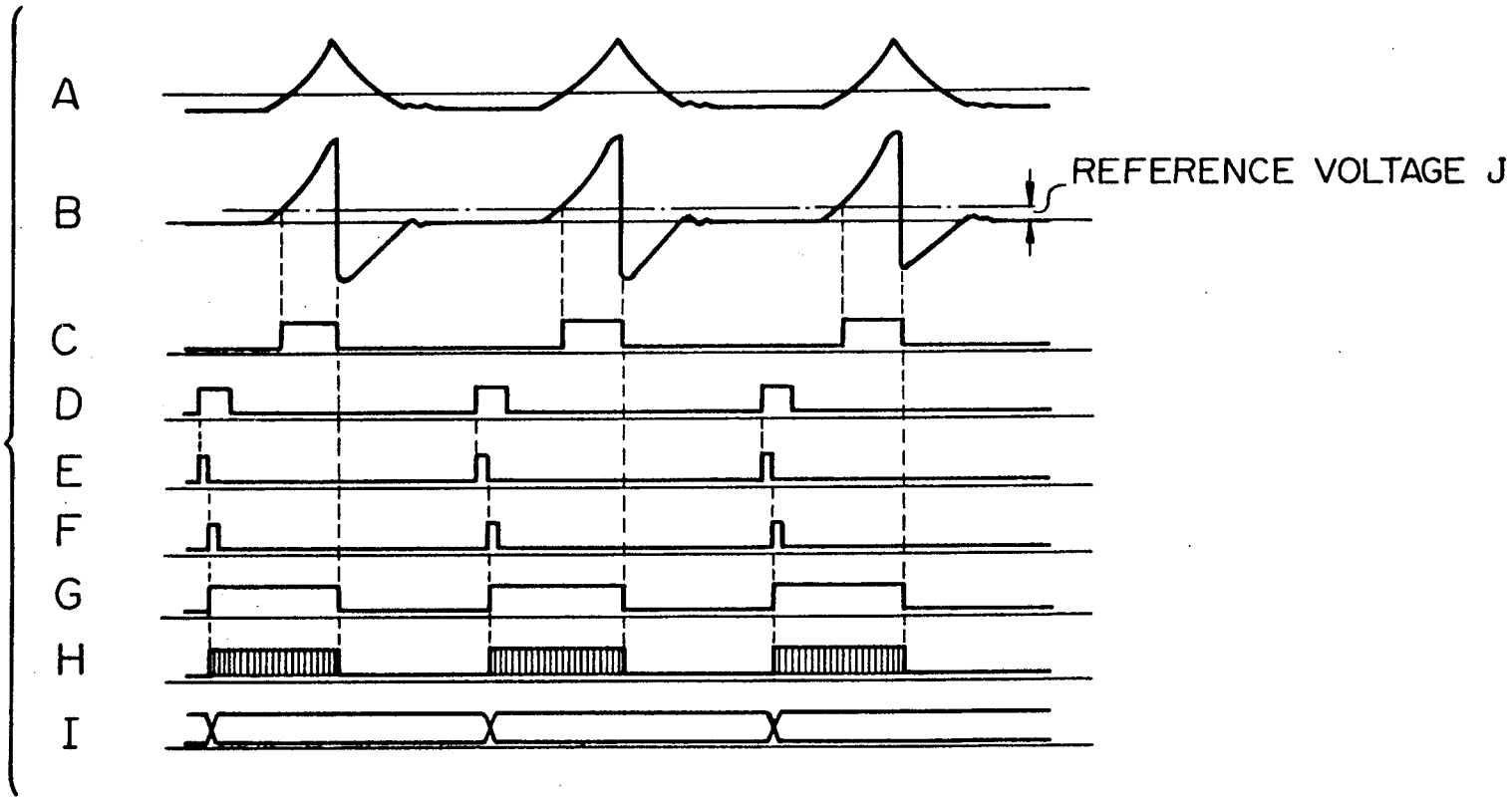
FIG. 25 is a waveform diagram of the operation of FIG. 24.

The drive timing detector circuit 290 will be described first. FIG. 24 is a block diagram of the, drive timing detector circuit 290, and FIG. 25 is a waveform diagram of an operation of the drive timing detector circuit 290.. In the same figures, designated at 250 is a differentiator, 251,is a comparator, 252 is a D flip-flop circuit, 253 is an 8-bit binary counter, 254 is a D latch, 255 is an AND circuit, 256, 257 are one-shot multivibrators (hereafter resistor. With the arrangement set forth above, the differentiator 250 receives a signal A from the sensor circuit 280*b*. The signal A is differentiated by the differentiator 250 and is changed to a signal B while the comparator 251 compares a reference voltage J produced by the variable resistor 259 with a voltage of the signal B to produce a signal C. The signal C will be 5 V at high level and while 0 V at low level and supplied to an input CK of the D flip-flop circuit 252.

Hereupon, an overdrive signal from the timer circuit 240 as a drive start signal D (drive timing signal) is applied to the inverse time 1 μs multivibrator 256. The multivibrator 256 detects the leading edge of the signal D (namely, the drive actuation time) and rises and issues a signal E which is inversed 1 μs later to the multivibrator 257 having inverse time 1 μs and an inut Clock of the D latch 254. The multivibrator 257 receives the signal E as a trigger signal and drops after detecting the trailing edge of the signal E to thereby issue a signal F which is inversed after 1 μs later and supplied to an input Clock of the D flip-flop circuit 252.

Accordingly, at the time when the drive start signal D goes to high level, the multivibrator 256 is inverted to thereby permit the D latch 254 to latch the value of the counter 253. The multivibrator 257 is inverted, just after latching of the D latch, to reset the counter 253 and reset the D flip-flop circuit 252 at the same time. The AND circuit 255 receives a signal G issued from an output NQ of the D flip-flop circuit 252 and a clock of 500 kHz which are ANDed to produce an AND signal H which is applied to an input Clock of the counter 253. Hence, the D flip-flop circuit 252 is reset and the counter 253 counts the signal H at the time when the signal G keeps high level.

Hereupon, the D flip-flop circuit 252 is set and the signal G of the output NQ is inverted to the low level when the output signal C of the comparator 251 rises, then drops. The leading edge and the trailing edge of the signal C correspond to an operation timing of the printing wire 20. That is, the time when the signal C rises accords with the time when the printing wire 20 actuates the operation and the time when the signal C drops accords with the time when the printing wire 20 strikes the printing paper. Accordingly, the signal of the output NQ of the D flip-flop circuit 252 keeps high level during the period from the application of the drive start signal D until the actuation of operation and striking the printing paper by the printing wire 20, and the counter 253 counts that period. The counted value is latched by the D latch 254 just after the application of the drive start signal D, the value of the counter 253 is cleared after latching. The value latched by the D latch 254 is supplied to the I/O LSI 3 as an 8-bit signal I and read by the CPU 2. A time resolution of the count value is 2 μs.

A deriving process of a delay signal to be applied to the timer circuit 240 will be described next. First, the delay circuit 250 will be described with reference to FIG. 23. As illustrated in the same figure, the timer delay circuit 250 comprises, as a counter 5*a*, a group of registers 5*b* and a group of comparators 5*c* wherein the counter 5*a* starts to count on the basis of instruction from the CPU 2 and stop counting on the basis of an instruction from the CPU 2 after lapse of prescribed period of time so that the counter 5a is reset. The registers 5*b* set the delay values independently for each printing wire 20. The delay values written in the registers 5*b* are compared with the value of the counter 5*a* by the comparators 5*c* which detects the timing when the value of the counter 5*a* exceeds over the values of the registers 5*b* and supplies a drive timing to the timer circuit 240.

Let us describe a process of calculation of delay time in the case of nine printing wires 20. The calculation of the delay time is fundamentally effected to conform timings of the other printing wires to the print timing which has the longest drive time among the nine printing wires. When the printing operation is actuated, a period data from the drive start to the impact, namely, the driving time is applied to the CPU 2. Assuming that the driving times corresponding to the printing wires 20 are $I_{t1}, I_{t2}, \ldots, I_{t9}$, and the delay values to be writen in the registers 4*b* . . . are $D_{t1}, D_{t2}, \ldots, D_{t9}$ The CPU 2 searches the maximum value of the drive time from Ith (n is an integer which is above 1 but below 9) to determined the maximum value, Imax. The delay values $D_{t1}, D_{t2}, \ldots, D_{t9}$ are set as following expression for conforming the print timing to the print wire having the longest drive time.

$$D_{t1} = Imax - I_{t1} + Co$$
$$D_{t2} = Imax - I_{t2} + Co$$
$$\vdots$$
$$D_{th} = Imax - I_{th} + Co$$
$$\vdots$$
$$D_{t9} = Imax - I_{t9} + Co$$

wherein Co is a correction value in view of an influence of the number of printing wires 20 to be simultaneously driven on the print timing and is stored in the ROM, of the CPU 2. According to the present embodiment, the more the increase in the number of printing wires 20 to be driven simultaneouly, the longer the drive time and slower the print timing so that the correction value Co as shown in the table in FIG. 26 is adopted.

Since the delay value $D_{th}$ is set as set forth above each printing wire strikes the printing paper after lapse of $(I_{th}+D_{th})$ from the drive timing. That is, if the above expression is given by the time $(I_{th}+D_{th})$, the values are expressed as (Imax+Co) for all the print wires, which means that the print timing is standardized to identify for all the printing wires.

According to the present embodiment having the arrangement set forth above, the timer circuit 240 sets the drive timings when the plurality of printing wires 20 actuate driving individually to thereby issue the drive timing signal to the head driver 6*a* and the drive time detector circuit 290. In addition, the sensor circuit 280*b* detects the electrostatic capacitance of the sensor electrode 280*a* for thereby detecting the print timing when the printing wire 20 strikes the printing paper, the print timing signal is supplied to the drive time detector circuit 290. The drive time detector circuit 290 detects the drive time for each printing wire 20 on the reception of the drive timing signal and the print timing signal and supplies the drive time data for the plurality of printing wires 20 to the CPU 2. The CPU 2 issues the delay value to the delay circuit 250 on the basis of the aforementioned drive time data so that the print timing for each printing wire is same at the next printing operation. The delay circuit 250 delays the drive timing of some printing wire among the printing wires to an appropriate time on the basis of the delay value so that the plurality of printing wires 20 can strike the printing paper simultaneously. Accordingly, a displacement of the print timing, when the printing wire strikes onto the printing paper, for each print wire 20 can be eliminated.

INDUSTRIAL APPLICABILITY

As mentioned above, the wire-dot impact printer according to the present invention enables the printing wire to strike the printing medium with a sufficient strength for obtaining a clear printed letter and is capable of eliminating the displacement of each print wire. Accordingly, it makes it possible to provide the wire-dot impact printer capable of printing at all times with high quality, thereby assuring very high industrial applicability.

We claim:

1. A wire-dot impact printer for printing an image on a printing medium, said wire-dot impact printer comprising:

a wire-dot print head disposed a predetermined distance from the printign medium;

a plurality of print wires disposed in said wire-dot print head, each of said plurality of print wires having a distal end and each being displaced in response to a drive signal so as to strike the printing medium with said distal end;

drive means for independently outputting said drive signal to each of said plurality of print wires, said drive means operating in response to a first print control signal applied thereto;

conveying means for conveying said wire-dot print head along the printign medium at said predetermined distance in response to a second print control signal applied thereto;

displacement detecting means for detecting a displacement resulting from said drive signal of at least one of said plurality of print wires and for outputting a corresponding displacement detecting signal; and, control means for outputting said first print control siganl to said drive means and said second print control siganl to said conveying means, and for controlling a print operation of the wire-dot impact printer in accordance with said displacement detection signal output by said displacement detecting means;

said control means including means for selectively delaying said drive signal applied to each of said plurality of print wires in accordance with said displacement detection signal.

2. A wire-dot impact printer as recited in claim 1, said control means including means for varying a time period between outputting of successive drive signals to each of said plurality of print wires in accordance with said displacement detecting signal.

3. A wire-dot impact printer as recited in claim 1, said displacement detecting means includign means for detecting a flight time of each of said plurality of print wires, said flight time being a time period from a point in time in which a printe wire is actuated in response to said drive signal to a point in time in which said print wire returns to an original position.

4. A wire-dot impact printer as recited in claim 2, said displacement detecting means including means for detecting a flight time of each of said plurality of print wires, said flight time being a time period from a point in time in which a print wire is actuated in response to said drive signal to a point in time in which said print wire returns to an original position.

5. A wire-dot impact printer as recited in claim 1, said displacement detecting means including means for detecting a drive current value supplied in response to said drive signal to each of said plurality of print wires, said displacement of said at least one of said plurality of print wires being detected in accordance with said drive current value.

6. A wire-dot impact printer as recited in claim 2, said displacement detecting means including means for detecting a drive current value supplied in response to said drive signal to each of said plurality of print wires, said displacement of said at least one of said plurality of print wires being detected in accordance with said drive crurent value.

7. A wire-dot impact printer as recited in claim 3, said displacement detecting means including means for detecting a drive current value supplied in response to said drive signal to each of said plurality of print wires, said displacement of said at least one of said plurality of print wires being detected in accordance with said drive crurent value.

8. A wire-dot impact printer as recited in claim 4, said displacement detecting means including means for detecting a drive current value supplied in response to said drive signal to each of said plurality of print wires, said displacement of said at least one of said plurality of print wires being detected in accordance with said drive crurent value.

* * * * *